US012564872B2

(12) United States Patent
Cha et al.

(10) Patent No.: US 12,564,872 B2
(45) Date of Patent: Mar. 3, 2026

(54) POCKET FLANGE FORMING DEVICE FOR DUCT

(71) Applicant: JINWOONG TECHNOLOGY CO., LTD., Hwaseong-si (KR)

(72) Inventors: Kyu-seok Cha, Seoul (KR); Seok Heo, Goyang-si (KR)

(73) Assignee: JINWOONG TECHNOLOGY CO., LTD., Hwaseong-si (KR)

( * ) Notice: Subject to any disclaimer, the term of this patent is extended or adjusted under 35 U.S.C. 154(b) by 300 days.

(21) Appl. No.: 18/342,537

(22) Filed: Jun. 27, 2023

(65) Prior Publication Data

US 2023/0415214 A1 Dec. 28, 2023

(30) Foreign Application Priority Data

Jun. 28, 2022 (KR) ..... 10-2022-0078652

(51) Int. Cl.
*B21D 5/14* (2006.01)
*B21D 5/00* (2006.01)

(52) U.S. Cl.
CPC ..... *B21D 5/14* (2013.01); *B21D 5/002* (2013.01)

(58) Field of Classification Search
CPC . B21D 5/08; B21D 5/086; B21D 5/14; B21D 19/043; B21D 5/002; B21C 37/101
See application file for complete search history.

(56) References Cited

U.S. PATENT DOCUMENTS 4,724,695 A * 2/1988 Stoehr ..... B21B 31/14 72/181
4,974,435 A * 12/1990 Vandenbroucke ..... B21D 5/08 72/179
5,107,695 A * 4/1992 Vandenbroucke ..... B21B 13/16 83/479
5,761,945 A * 6/1998 Vandenbroucke ... B23D 35/008 72/181
5,829,294 A * 11/1998 Bradbury ..... B21D 5/08 72/181
6,000,266 A * 12/1999 Strecker ..... B21B 31/08 72/181

(Continued)

OTHER PUBLICATIONS

KR 100597567B1, Cha et al. Jul. 2006.*
EP 0537594A2, Lonoce Apr. 1993.*

*Primary Examiner* — Edward T Tolan
(74) *Attorney, Agent, or Firm* — KILE PARK REED & HOUTTEMAN PLLC

(57) ABSTRACT

Disclosure is a pocket flange forming device for a duct. When a plate enters a forming molding unit provided at the opposite sides of the forming device while being seated on a transfer unit, pocket flanges serving as duct connecting portion are formed on longitudinal edges on the opposite sides of the plate through the forming-molding method such as bending, folding, and compressing in addition to transferring, and the forming molding unit is rotated by 180 degrees to match with molding positions of forming rollers of the left and right forming molding unit, and a gap between the forming molding unit and another forming molding unit is set by a gap adjusting part, so that the pocket flanges having the same size or different sizes at the opposite sides thereof can be molded at the same time. Accordingly, the production performance and productivity of the pocket flanges can be enhanced.

12 Claims, 21 Drawing Sheets

(56) References Cited

U.S. PATENT DOCUMENTS

| | | | | |
|---|---|---|---|---|
| 6,148,654 | A * | 11/2000 | Jensen | B21D 5/08 72/181 |
| 7,096,702 | B2 * | 8/2006 | McDonald | B21D 5/08 72/181 |
| 8,783,081 | B2 * | 7/2014 | Voth | B21D 5/08 72/181 |
| 2008/0115550 | A1 * | 5/2008 | Walle | B21D 19/00 72/181 |

* cited by examiner

POCKET FLANGE FORMING DEVICE FOR DUCT

CROSS REFERENCE TO RELATED APPLICATION

The present application claims priority to Korean Patent Application No. 10-2022-0078652 filed Jun. 28, 2022, the entire contents of which is incorporated herein for all purposes by this reference.

BACKGROUND OF THE INVENTION

Field of the Invention

The present disclosure relates to a pocket flange forming device for a duct. More particularly, the present disclosure relates to a pocket flange forming device for a duct, the pocket flange forming device being capable of forming pocket flanges bi-directionally according to sizes of the pocket flanges with a plate for manufacturing the duct entering the forming device and passing through a plurality of forming rollers thereof.

Description of the Related Art

In general, in a ceiling of a building where an air conditioner is equipped, a duct through which cooling and heating fluids discharged from the air conditioner flow is installed. Typically, the duct is manufactured by molding galvanized steel plates (tin) having a certain thickness in a bending method and then combining the molded objects.

Furthermore, the duct has a structure in which a plurality of unit ducts are assembled by being connected to each other with bolts and nuts, and is used as a pipe of a ventilation facility for air circulation. Specifically, recently, a duct structure in which the unit ducts are connected to each other with flanges having a predetermined shape and strength of a connection portion therebetween is reinforced has been developed.

For example, in the "Flange of duct" disclosed in Korean Utility Model Publication No. 0248233 of the present applicant, a structure of a flange integrally formed to be bent at both ends of a duct and reinforced in rigidity and strength is shown.

Furthermore, in order to compensate for a problem of the duct flange as described above, the present applicant registered Korean Patent No. 10-0597567 (Title: Pocket flange of a duct, date of registration: Jun. 29, 2006, hereinafter which is referred to as "patent document").

Each of the pocket flanges in the patent document as described above has a coupling part vertically bent and extending from a duct, and a bent part extending to be bent again from the coupling part toward the duct, and an end extending from the bent part is disposed on a bottom surface, and while the end extending from the bent part is in contact with the duct, the duct is bent to cover an edge portion and an upper surface of the end, and the duct is bent reversely to be compressed together. Therefore, since a welding process is not included in the manufacturing process, consumables or power required for the welding process are unnecessary, so the economic efficiency is high and the manufacturing process is simple, and since there is no corrosion caused by welding or shearing, the flanges are not separated from the duct and do not become damp, so the durability thereof is excellent, and each of the flanges has a large thickness at an edge of the end, so the structural strength is increased.

Molding of the pocket flanges is performed by bending, folding, and compressing edges of the plate sequentially through a plurality of the forming rollers.

For example, looking at the related art for a similar molding device for molding of the pocket flange of a duct as described above, Korean Patent No. 10-1888294 (Title: Rainwater drainage molding equipment for roofs of buildings, date of registration: Aug. 7, 2018) was disclosed.

In the process, the metal plate is bent while opposite side portions of the plate pass through the plurality of molding rollers so that a rainwater drainage can be manufactured while a processing time is sharply reduced with one molding device.

Similar to the bending-molding method for a plate as described above, molding of a pocket flange for a duct may be performed by uniformly molding pocket flanges like the related art through a plurality of forming rollers disposed longitudinally, but the pocket flanges were manufactured by moving the plate in one direction, and after completing molding of one length side portion of the plate, and then inserting and molding the opposite side portion into the molding device in the same manner as described above.

Therefore, manufacture of a molding takes a lot of time, and molding devices with different molding sizes are required in order to mold pocket flanges with different sizes for manufacturing a duct, so there is a problem in that the productivity of a product according to design and manufacturing, installation, and operation of the molding device should be considered.

DOCUMENTS OF RELATED ART (Patent Document 1) Korean Patent No. 10-0597567 (date of registration Jun. 29, 2006)

SUMMARY OF THE INVENTION

The present disclosure is invented to solve the problems occurring in the related art, and is intended to provide a pocket flange forming device for a duct, the forming device being configured to form pocket flanges bi-directionally according to different sizes while a plate enters the forming device and passes through a plurality of forming rollers for duct manufacturing.

According to the present disclosure to achieve the above described objective, there may be provided a pocket flange forming device for a duct, the pocket flange forming device being configured to mold pocket flanges, which may be connecting portions of a duct, on longitudinal edge portions at opposite ends of a plate made of a rectangular metal plate, through a sequential forming process, the forming device including:

a base combined with a beam and constructed from a bottom surface; a stand disposed at each of left and right portions of an upper portion of the base to be in parallel to each other and provided to be movable by a gap adjusting part provided at the upper portion of the base; a fixing stand disposed at each of front and rear portions of upper left and right portions of the stand to correspond to each other while being stood; a forming molding unit rotatably provided between the fixing stand and another fixing stand at the front and rear sides, and including a plurality of forming rollers continuously provided at opposite sides of supports corresponding to each other to form pocket flanges on longitudinal edges at opposite sides of the plate inserted between the forming rollers, by sequentially performing molding process of bending, folding, and compressing; a first rotary driving unit provided at the stand and configured to transmit power to the forming rollers of the forming molding unit; a second rotary driving unit provided at the stand and configured to rotate the entire forming molding unit by 180 degrees against the fixing stand (130); a transfer unit provided at the upper portion of the base and configured to support the plate to transfer the plate to the forming molding unit provided at the opposite sides, in one direction; an elevation stand unit provided at an upper portion of the stand to be raisable and lowerable and configured to support a lower portion of the rotated forming molding unit; and a fixation units provided on an upper portion of the fixing stand and configured to fix the forming molding unit rotated by 180 degrees.

According to the present disclosure, the gap adjusting part may include:

a second driving motor provided on the base, a second reducer connected to the second driving motor to transmit power, a transfer screw shaft of which a first end may be connected to an output shaft end of the second reducer and a second end may be rotatably supported on the base while passing through a lateral surface of the stand, and a guide rail and a guide, the guide rail being configured to guide each of the stand and another stand at left and right sides on the base with the transfer screw shaft and the guide being provided at a lower portion of the stand to be guided along the guide rail.

According to the present disclosure, each of the supports corresponding to each other of the forming molding unit may include: one or more shaft fixing stands continued in a longitudinal direction, and provided to be vertically adjustable at upper and lower portions at opposite sides of the supports, and a first roller shaft rotatably provided to each of the shaft fixing stands and coupled to, at opposite ends thereof, the forming rollers, a second roller shaft rotatably provided on the supports, and coupled to, at opposite ends thereof, forming rollers to match with the forming rollers on the first roller shaft for forming molding, a driving gear coupled to each of the first roller shaft and the second roller shaft and configured to allow engagement rotation driving, a ring gear connected to one of the supports and another support while being located therebetween, and configured to be transmitted with power from the second rotary driving unit to rotate the forming molding unit entirely, and a roller power transmission part provided at second roller shafts at the supports at the opposite sides based on the ring gear and configured to rotate the second roller shafts at the supports in the same rotating direction.

According to the present disclosure, the roller power transmission part may include a sprocket wheel coupled to the second roller shaft at the supports at opposite sides based on the ring gear and a chain connecting the sprocket wheel to another sprocket wheel.

According to the present disclosure, the ring gear may include:

a ring part, a gear part, the gear part engaged with the roller power transmission part, the gear part being combined with one side of the ring part, a through hole formed in each of upper and lower positions for penetration of the chain, and a cut groove part formed in each of opposite portions of the ring gear for passing the plate to be formed.

According to the present disclosure, the forming rollers may include:

an upper forming roller coupled to a first portion of a first roller shaft of an upper shaft fixing stand, and a lower forming roller coupled to a second portion of a first roller shaft of a lower shaft fixing stand, wherein the upper forming roller and the lower forming roller may have different sizes.

According to the present disclosure, the first rotary driving unit may include:

a main driving motor, a first reducer connected to the main driving motor, including output shafts at opposite sides thereof, and respectively provided at each of front and rear portions of the base, and a first gear driving part configured to transmit power from each of the opposite output shafts of the first reducer to the forming rollers of the forming molding unit.

According to the present disclosure, the first gear driving part may be configured to achieve power transmission by engagement between bevel gears and spur gears engaged with the bevel gears that may be provided at the output shafts of the first reducer and at second roller shaft of supports located at a start position and an end position where the plate may enter, be molded, and then be discharged, among second roller shafts of the forming rollers of each of the forming molding unit.

According to the present disclosure, the second rotary driving unit may include:

a first driving motor provided on the stand, a power transmission shaft connected to a shaft of the first driving motor, and a second gear driving part provided on the stand, and including a driving gear and a driven gear that may be rotatably provided, the driving gear being provided on the power transmission shaft and the driven gear being disposed in an arc shape at one side of the driving gear to be engaged with the ring gear.

According to the present disclosure, the transfer unit may include:

a conveyor provided to match with a height level of the forming rollers disposed in the forming molding unit from the base and configured to transfer the plate, a pressure roller and a pressure roller support, the pressure roller being provided to be spaced apart from an upper portion of the conveyor and configured to pressurize and guide an upper portion of the plate that may be seated and transferred on the conveyor, and a conveyor driving part configured to drive the conveyor in one direction.

According to the present disclosure, the elevation stand unit may include:

a support plate securely provided on the stand, a hydraulic cylinder securely provided to be vertical from the support plate and guide rods passing through a plurality of points on the support plate, and an elevation support block connected to an end of an operation rod of the hydraulic cylinder and ends of the guide rods to support a lower portion of each of the supports of the forming molding unit.

According to the present disclosure, the fixation unit may be securely provided at each of supports located at a front side and a rear side where the plate may enter and be discharged, among the supports of each of the forming molding unit, and the fixation unit may include a rotation plate including a plurality of fixing blocks provided at upper and lower portions thereof, and sensor detection stands, a pair of fixing cylinders provided on an upper portion of the fixing stand on the stand and holding the fixing blocks, and detection sensors securely provided on upper portions of the fixing cylinders to detect the sensor detection stands.

According to the present disclosure, the pocket flange forming device is configured as follows. When the plate enters the forming molding unit provided at the opposite sides of the forming device while being seated on the transfer unit, the pocket flanges serving as duct connecting portion are formed on the longitudinal edges on the opposite sides of the plate through the forming-molding method such as bending, folding, and compressing in addition to transferring, and the forming molding unit is rotated by 180 degrees to match with molding positions of the forming rollers of the left and right forming molding unit, and a gap between the forming molding units is set by the gap adjusting part, so that the pocket flanges having the same size or different sizes at the opposite sides thereof can be molded at the same time. Accordingly, the production performance and productivity of the pocket flanges serving as duct connecting portions can be sharply enhanced.

DETAILED DESCRIPTION OF THE INVENTION

Figure 1:
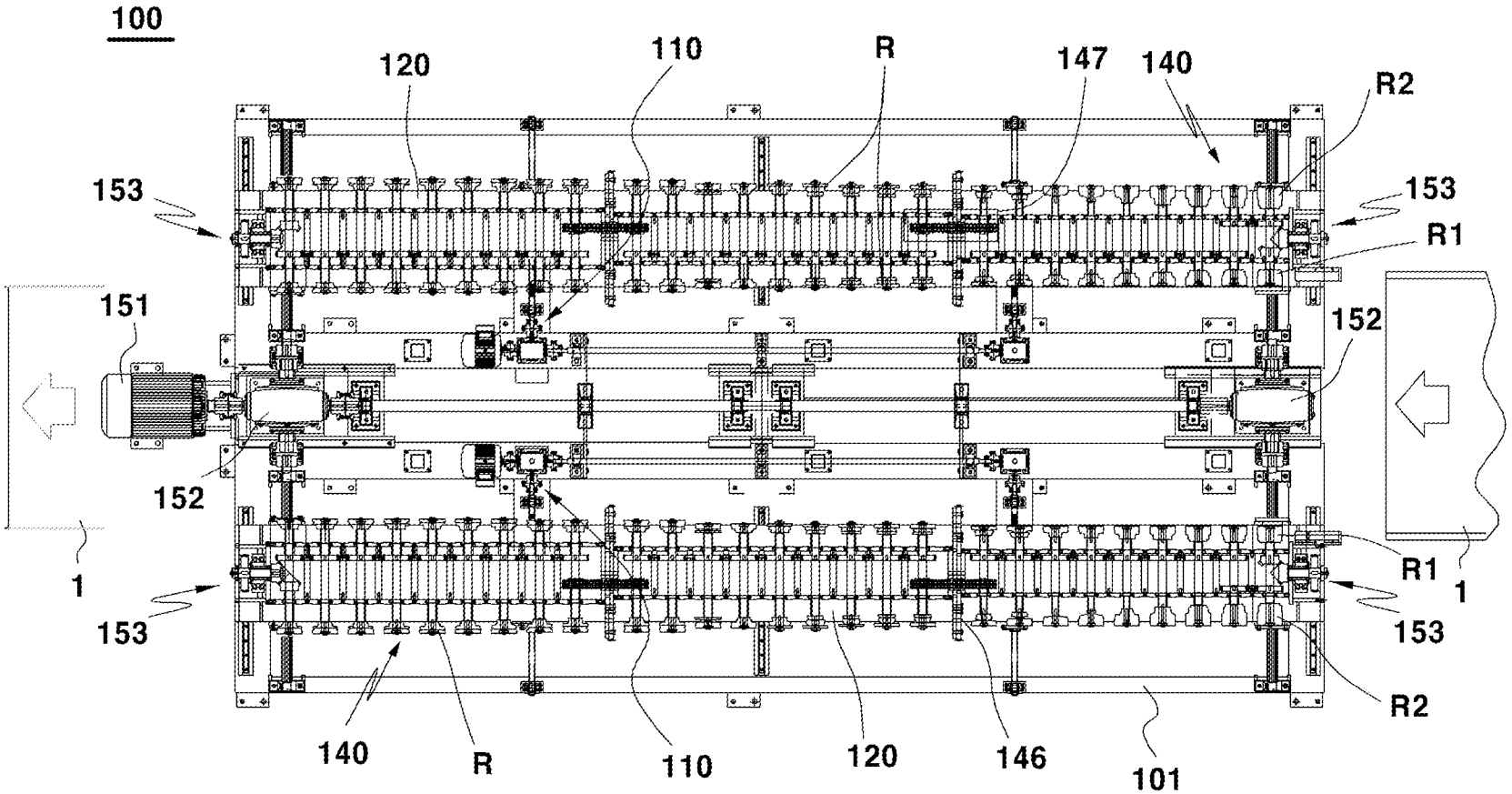
FIG. 1 is a plan view showing a forming device of the present disclosure.

Hereinbelow, the present disclosure will be described in detail with reference to accompanying drawings.

All terms or words used in the specification and claims have the same meaning as commonly understood by one of ordinary skill in the art to which inventive concepts belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Therefore, the embodiments described in the specification and the configurations shown in the drawings are merely examples and do not exhaustively present the technical spirit of the present disclosure. Accordingly, it should be appreciated that there may be various equivalents and modifications that can replace the embodiments and the configurations at the time at which the present application is filed.

According to the present disclosure, a forming device will be described with reference accompanying.

the pocket flange forming device being configured to mold pocket flanges (1*a*), which are connecting portions of a duct, on longitudinal edge portions at opposite ends of a plate (1) made of a rectangular metal plate, through a sequential forming process, As shown in FIGS. 1 to 4, the forming device 100 includes a stand 120 seated on an upper portion of a base 101 combined with a beam and constructed from a bottom surface, a fixing stand 130 provided on an upper portion of the stand, a forming molding unit 140 provided at the fixing stands so as to mold pocket flanges on portions at opposite sides of a plate, a first rotary driving unit 150 transmitting power to forming rollers R of the forming molding unit 140, a second rotary driving unit 160 rotating the entire forming molding unit 140 by 180 degrees, a transfer unit 170 supporting the plate 1 to transfer the plate 1 in one direction, an elevation stand unit 180 supporting a lower portion of the forming molding unit 140, a fixation unit 190 fixing the forming molding unit 140, and a gap adjusting part 110 provided to perform gap adjustment between the forming molding unit 140 and another forming molding unit 140.

Figure 3:
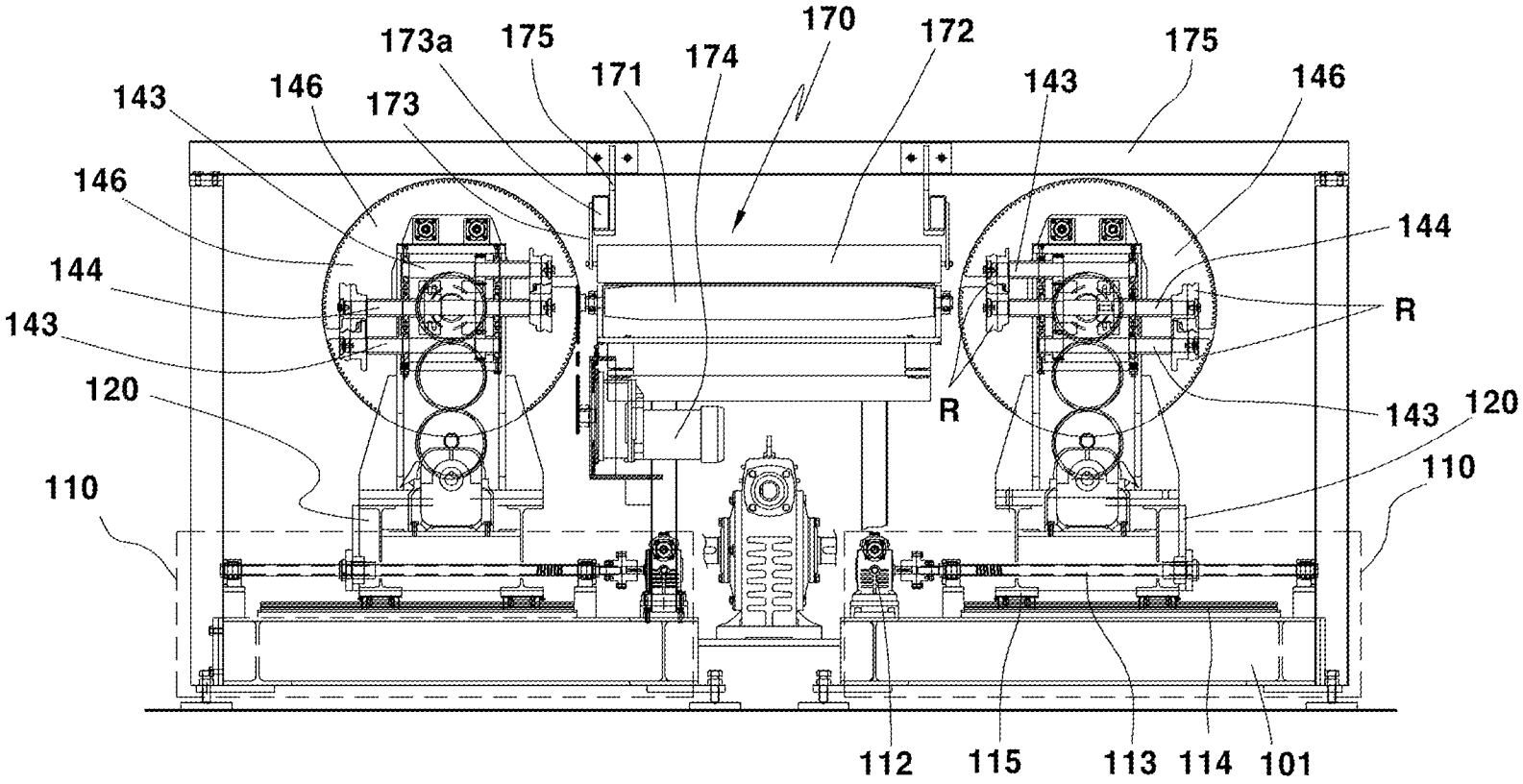
FIG. 3 is a side view showing the forming device according to the present disclosure.
Figure 4:
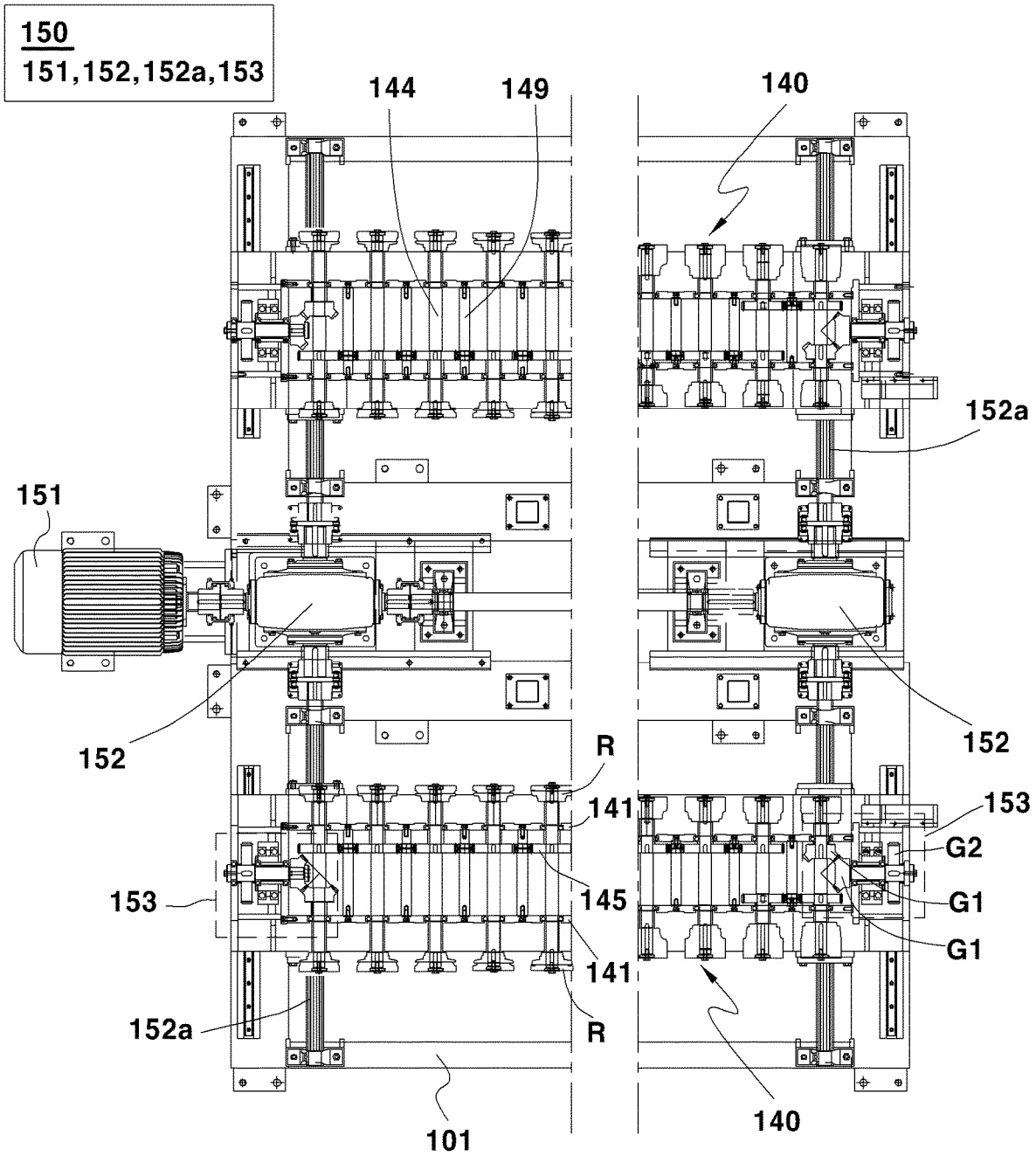
FIG. 4 is a plane view showing a first rotary driving unit transmitting power to forming rollers of a forming molding unit of according to the present disclosure.
Figure 17:
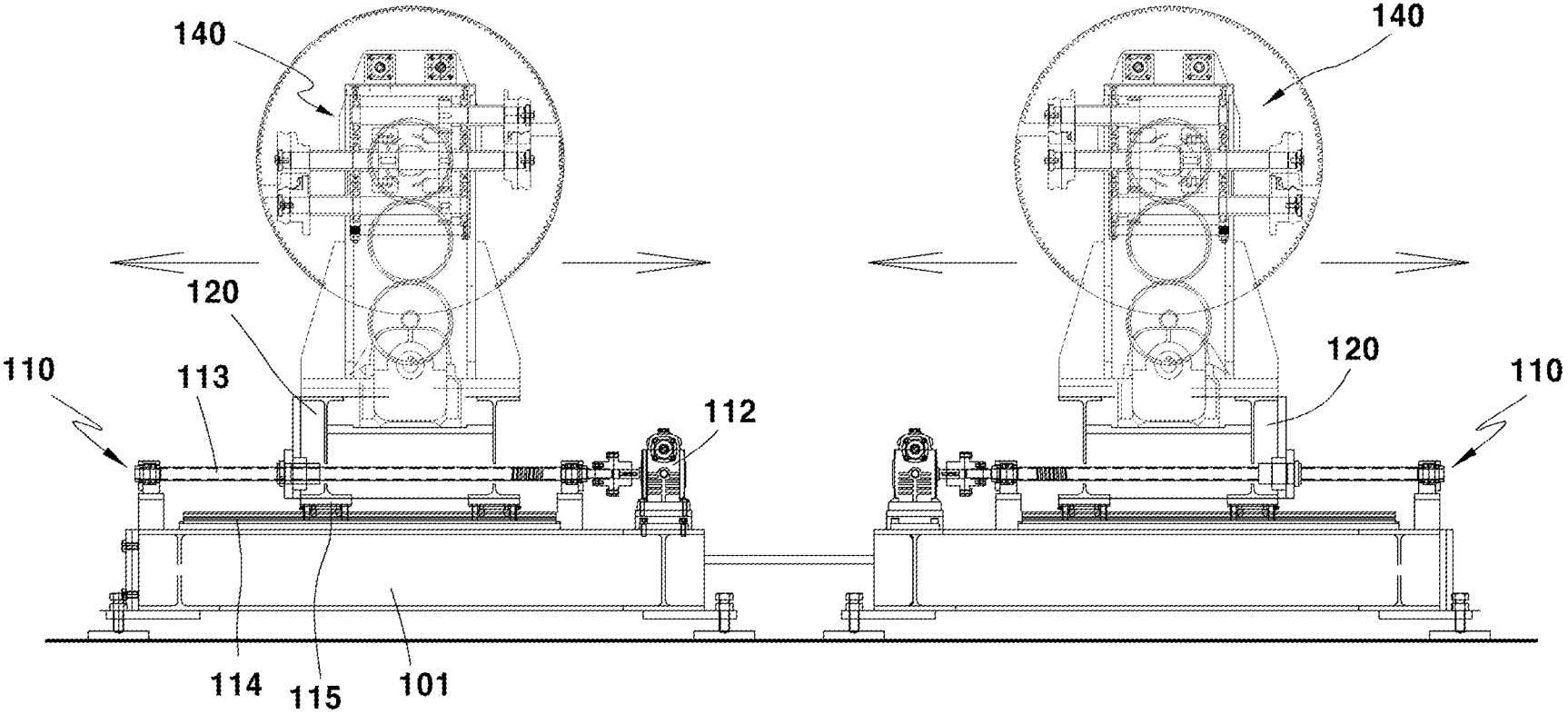
FIG. 17 is a side view showing a gap adjusting part of the forming device according to the present disclosure.

As shown in FIGS. 3 and 17, the gap adjusting part 110 includes a second driving motor 111 mounted on the base 101, a second reducer 112 connected to the second driving motor 111 to transmit power, a transfer screw shaft 113 of which a first end is connected to an output shaft end of the second reducer 112 and a second end is rotatably supported on the base 101 while passing through a lateral surface of the stand 120, a guide rail 114 guiding each of left and right stands 120 on the base 101 with the transfer screw shaft 113, and a guide 115 provided at a lower portion of the stand 120 to be guided with the guide rail 114.

In other words, the gap adjusting part 110 may perform the gap adjustment of the forming molding unit 140 according to the width of the plate 1 so as to achieve molding of the pocket flanges 1*a*.

The stands 120 respectively located on upper left and right portions of the base 101 are in parallel to each other in beam shapes and are provided to be movable by the gap adjusting part 110 provided from an upper portion of the base 101.

The fixing stand 130 is disposed at each of front and rear sides of the upper left and right portions of the stand 120 in standing shapes to correspond to another fixing stand.

The forming molding unit 140 is a main part that is rotatably provided between the fixing stand 130 and another fixing stand 130 that are located at the upper front and rear sides of the stand 120, and include a plurality of forming rollers R that are continuously provided at opposite sides of the supports 141 corresponding to each other, and form pocket flanges 1*a* on longitudinal edges at opposite sides of the plate 1 entering between upper and lower forming rollers, by sequentially performing bending, folding, and compressing molding.

Figure 6:
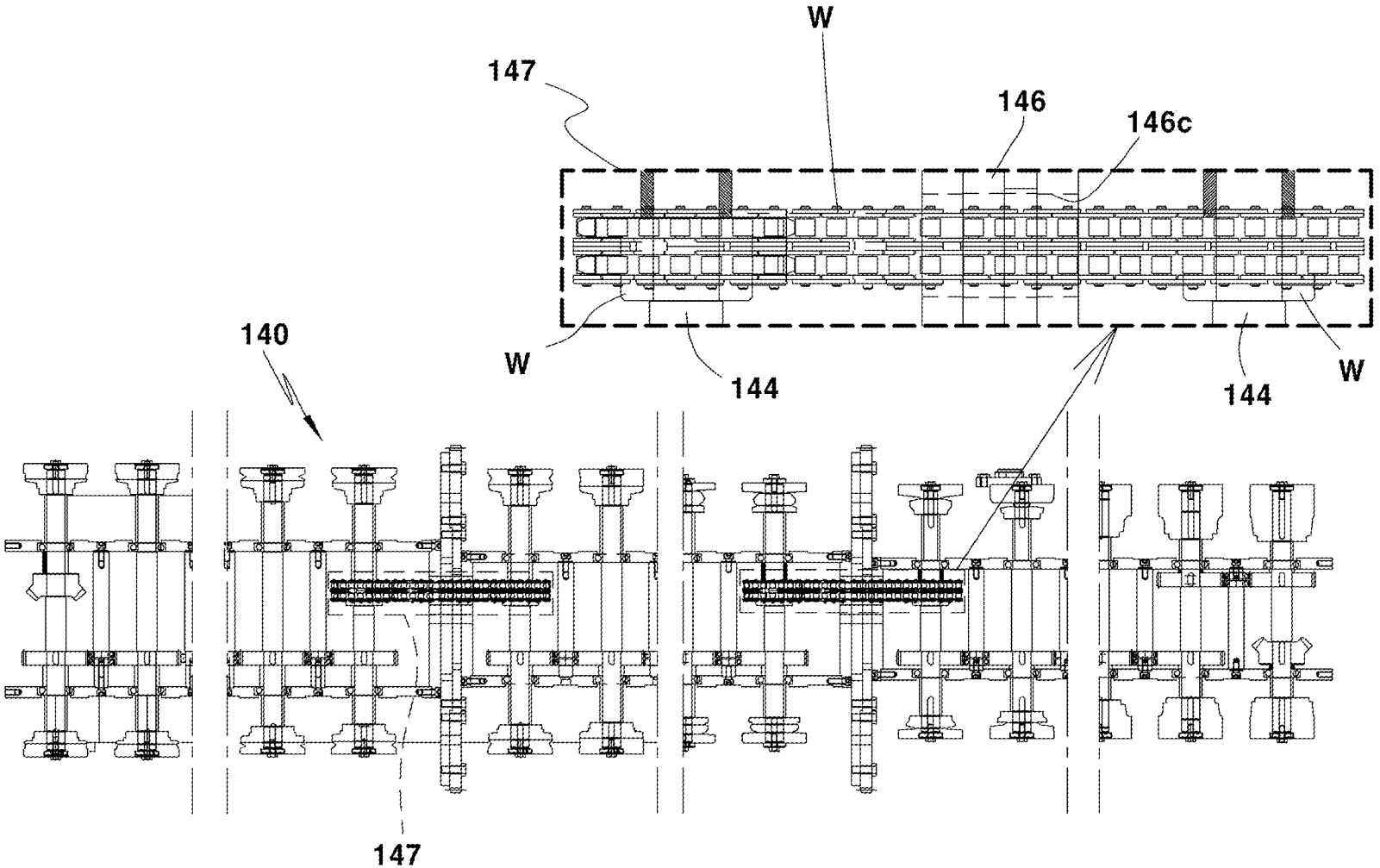
FIG. 6 is a plan view showing the forming molding unit, which is abstracted from the forming device according to the present disclosure.
Figure 7:
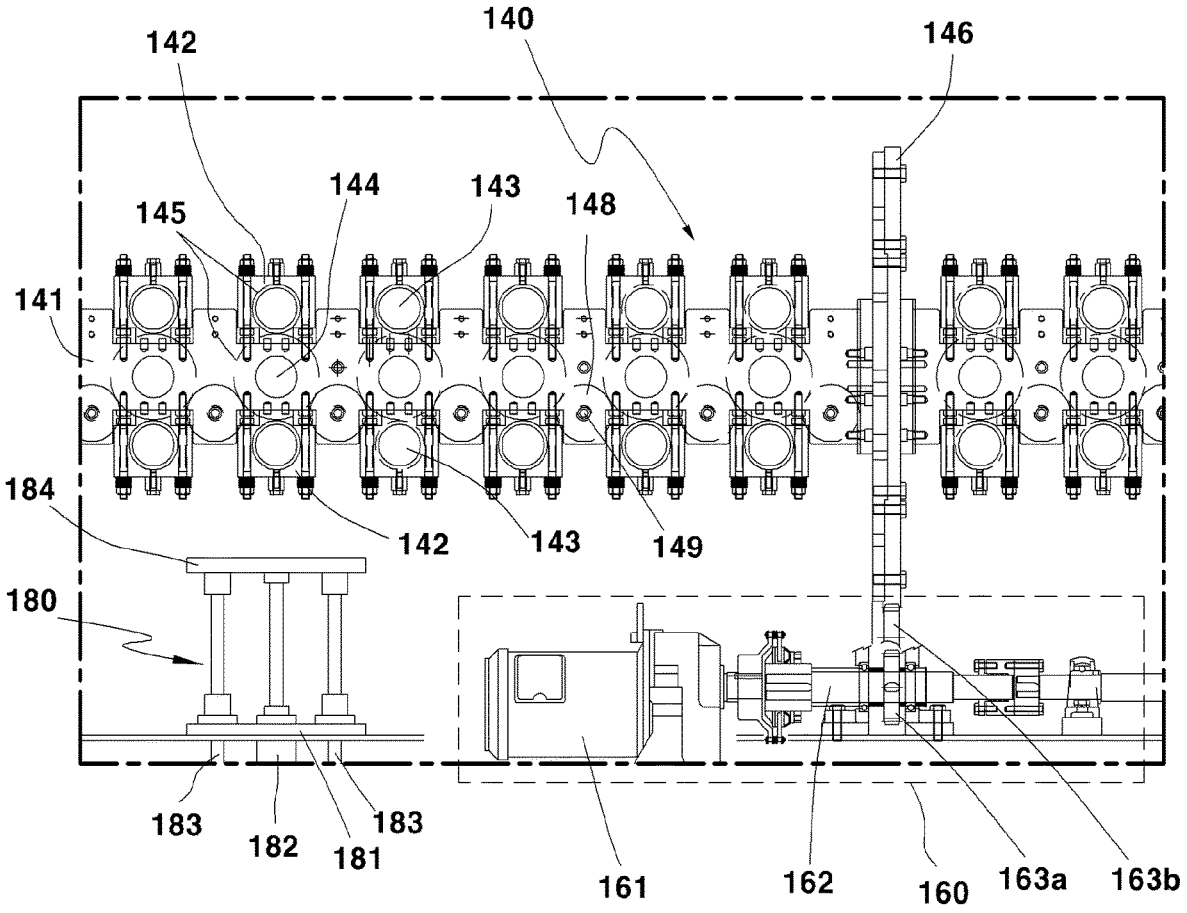
FIG. 7 is a front view showing the forming molding unit shown in FIG. 6.
Figure 8:
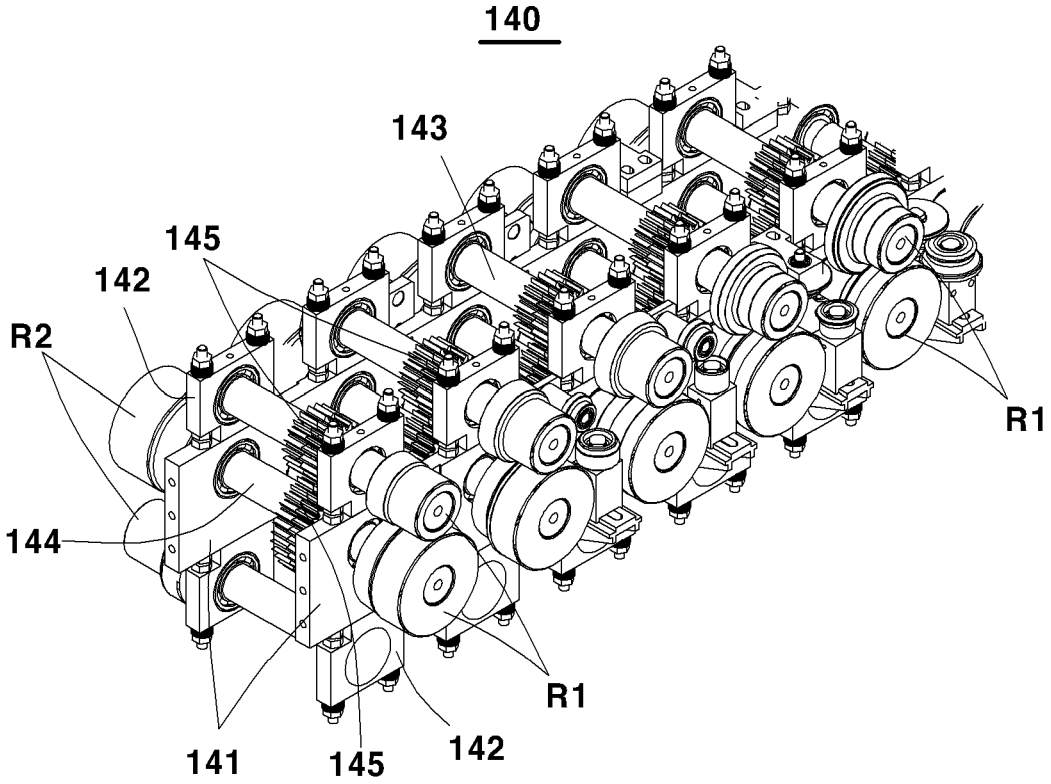
FIG. 8 is a partially abstracted-perspective view showing mutual driving relationship between shafts of the forming rollers of the forming molding unit according to the present disclosure.

More specifically, as shown in FIGS. 6 and 8, each of the supports 141 of the forming molding unit 140 corresponding to each other includes one or more shaft fixing stands 142 continued in a longitudinal direction, and provided to be vertically adjustable at upper and lower portions at opposite sides of the supports 141, and first roller shafts 143 rotatably installed at the shaft fixing stands and coupled to, at opposite ends thereof, the forming rollers R, second roller shafts 144 rotatably installed at the supports 141 and coupled to, at opposite ends thereof, the forming rollers R to match with the forming rollers R on the first roller shafts 143 for the forming molding, driving gears 145 coupled to the first roller shafts 143 and the second roller shafts 144 to allow engaged rotary driving, a ring gear 146 connected to one of the supports 141 and another support 141 while being located therebetween and transmitted with power from the second rotary driving unit 160 to rotate the forming molding unit 140 entirely, and a roller power transmission part 147 installed at second roller shafts 144 at the supports 141 at the opposite sides based on the ring gear 146 and rotating the second roller shafts 144 at the supports 141 in the same rotating direction.

The driving gears 145 coupled onto the first roller shafts 143 and the second roller shafts 144 are engaged with an idle gear 148 installed on an idle shaft 149 of which opposite ends are shaft-installed in the support 141 to transmit rotary power.

Figure 9:
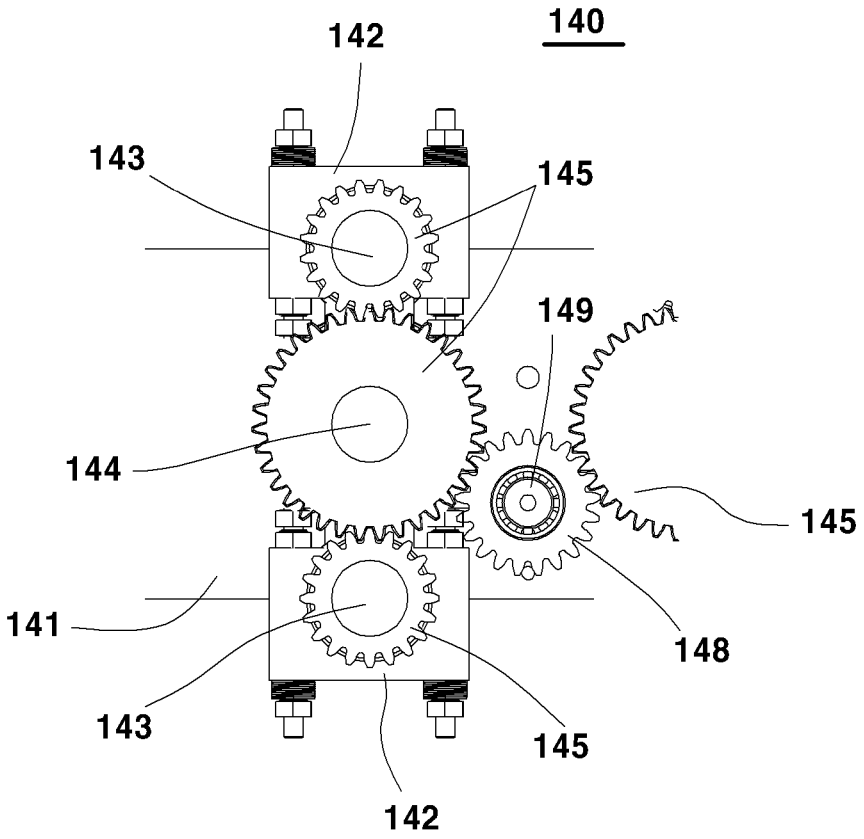
FIG. 9 is a sectional view showing an engagement state between gears on a first roller shafts and a second roller shafts to which the forming rollers are coupled, shown in FIG. 8.

As shown in FIGS. 8 and 9, the shaft fixing stands 142 are guided to depressed parts that are provided at a longitudinal edge of each of the support 141, and consist of a coupling bolt, nut, and compression spring so as to perform a vertical adjustment, so as to adjust the first roller shafts 143.

In other words, each of the shaft fixing stands 142 is configured to adjust a gap below and above the support 141 by adjusting gaps between the forming rollers R on the first roller shafts 143 and the forming rollers R on the second roller shafts 144 penetrating through and supported by the support 141 to be directly rotatable. The shaft fixing stand 142 is configured to set a gap by adjusting the forming rollers R on the first roller shafts 143 on the basis of the forming rollers on the second roller shafts 144.

Describing the forming rollers R, the forming rollers are rollers in which portions molded at outside portions thereof are slightly different in shape to sequentially bend and fold the longitudinal edges of the plate 1 passing through each of the forming rollers, and to compress folded portions.

The forming rollers R are respectively coupled to opposite ends of each of the second roller shafts 144 rotatably installed in the support 141, and the first roller shafts 143 on the shaft fixing stands 142 are installed in parallel to the second roller shafts 144 and to the shaft fixing stands 142 of each of the supports 141. One forming roller is coupled to a first end of each of the first roller shafts 143 and installed to be closer to the forming rollers R provided on the second roller shafts 144.

In other words, based on the drawings, the forming rollers R coupled to the first roller shafts 143 of the upper shaft fixing stands 142 and the forming rollers coupled to the first roller shafts 143 of the lower shaft fixing stands 142 are disposed to be misaligned from each other by 180 degrees to correspond closely to the forming rollers provided at the second roller shafts 144.

The center forming rollers provided at the second roller shafts 144 may bent the plate by matching with the upper forming rollers provided the first roller shafts 143 of the upper shaft fixing stands or the lower forming rollers of the lower shaft fixing stands.

When a set of the center forming roller and the upper forming roller that are disposed at a first side is referred to as a first forming roller R1 and a set of a center forming roller and a lower forming roller that are disposed at a second side is referred to as a second forming roller R2, the first forming roller and the second forming roller have different sizes. In other words, the upper forming roller and the lower forming roller are disposed to be misaligned by 180 degrees, and have different diameters. Furthermore, the center forming rollers disposed at opposite sides also have the sizes different from each other. When the upper forming roller is larger than the lower forming roller, the center forming roller matches with the lower forming roller, so the center forming roller at the upper forming roller is formed larger than another center forming roller.

As shown in FIG. 1, the forming rollers are disposed at the opposite sides based on the plate 1 as the center, and the first forming roller R1 may be disposed at a position close to the plate 1 and the second forming roller R2 may be disposed at an outside position far away from the plate 1. When flanges of the plate 1 are molded by the first forming roller R1 and then the second forming roller R2 is disposed inward by rotating the forming rollers 180 degrees, the flanges of different sizes can be molded.

Conventionally, when molding of flanges having different sizes is performed, replacement of the forming rollers is required, but according to the present disclosure, flanges having different sizes can be molded by rotating the forming rollers by 180 degrees. Therefore, work efficiency can be improved.

Figure 2:
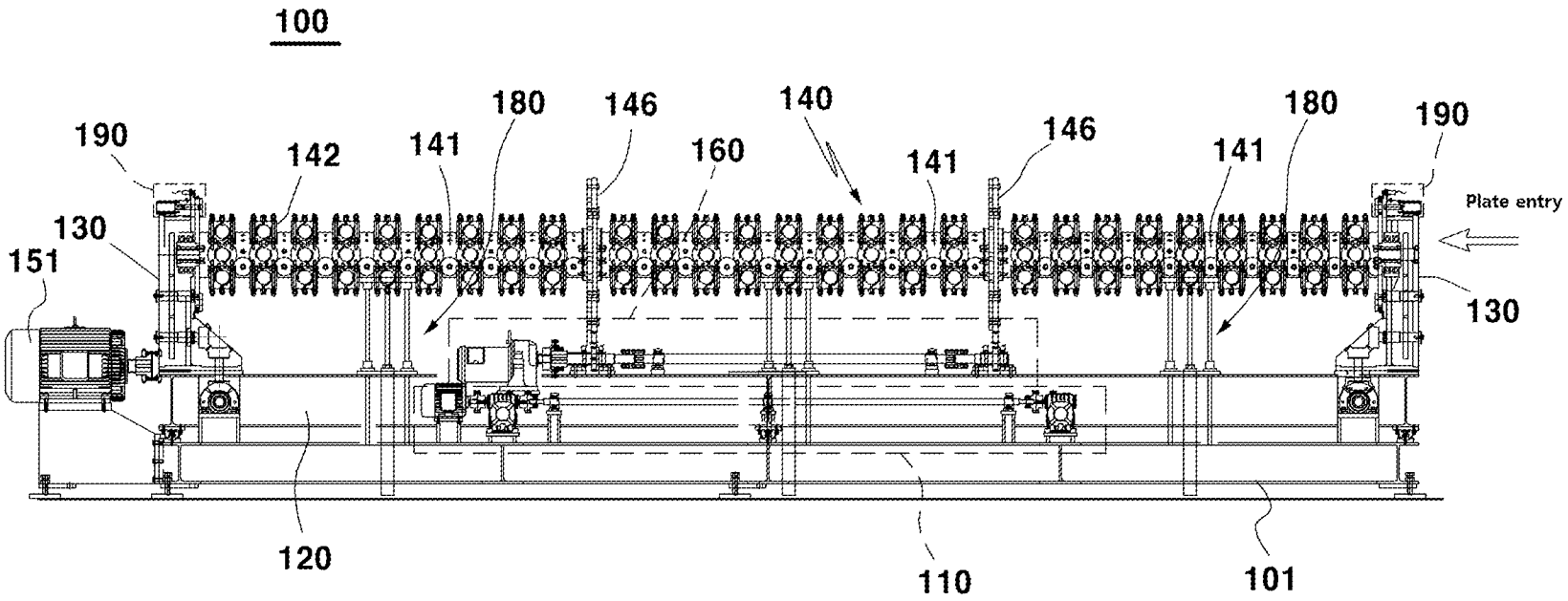
FIG. 2 is a front view showing the forming device according to the present disclosure.

As shown in FIGS. 1 and 2, the support 141 of the forming molding unit 140 are three parts with respect to the total length of the forming molding unit and one of the support 141 and another support are connected to each other by the ring gear 146 located therebetween, which will be described below.

The roller power transmission part 147 includes sprocket wheels W coupled to the second roller shafts 144 at the support 141 opposite to each other based on the ring gear 146 and a chain C connecting the sprocket wheels W to each other. As described above, the roller power transmission part 147 is provided to the support of the three parts, and serves as one power transmission medium to transmit rotary power between the supports.

Figure 13:
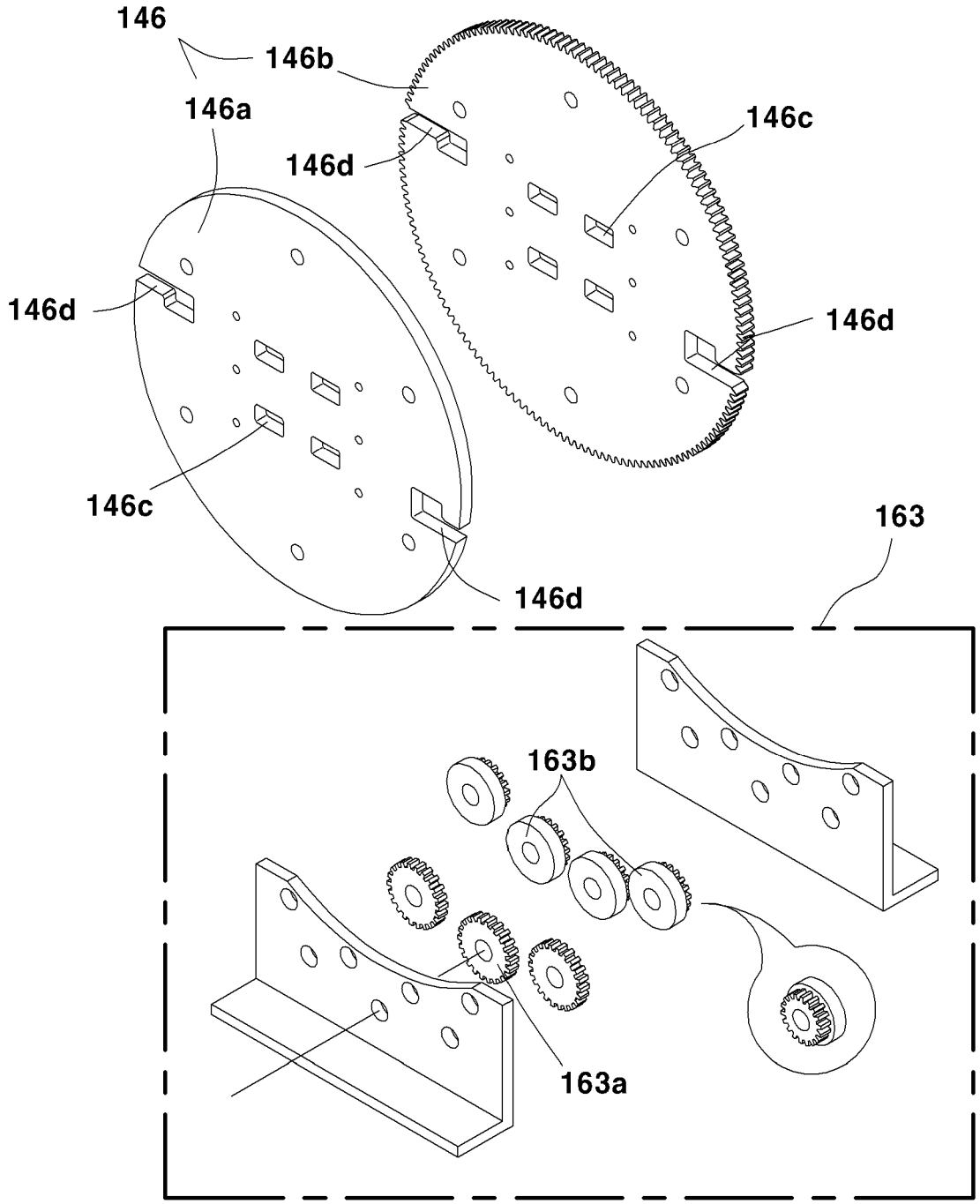
FIG. 13 is a perspective view showing the ring gear and a driving gear and a driven gear of the second rotary driving unit, which are abstracted from FIG. 11.

As shown in FIG. 13, the ring gear 146 is composed of a ring part 146*a*, a gear part 146*b*, wherein the gear part 146*b* engaged with the roller power transmission part 147 is integrated to one side of the ring part, and through holes 146*c* for penetration of the chain C are formed at upper and lower positions, and cut groove parts 146*d* are formed in opposite portions of the ring gear for passing the plate 1 to be formed.

Figure 5:
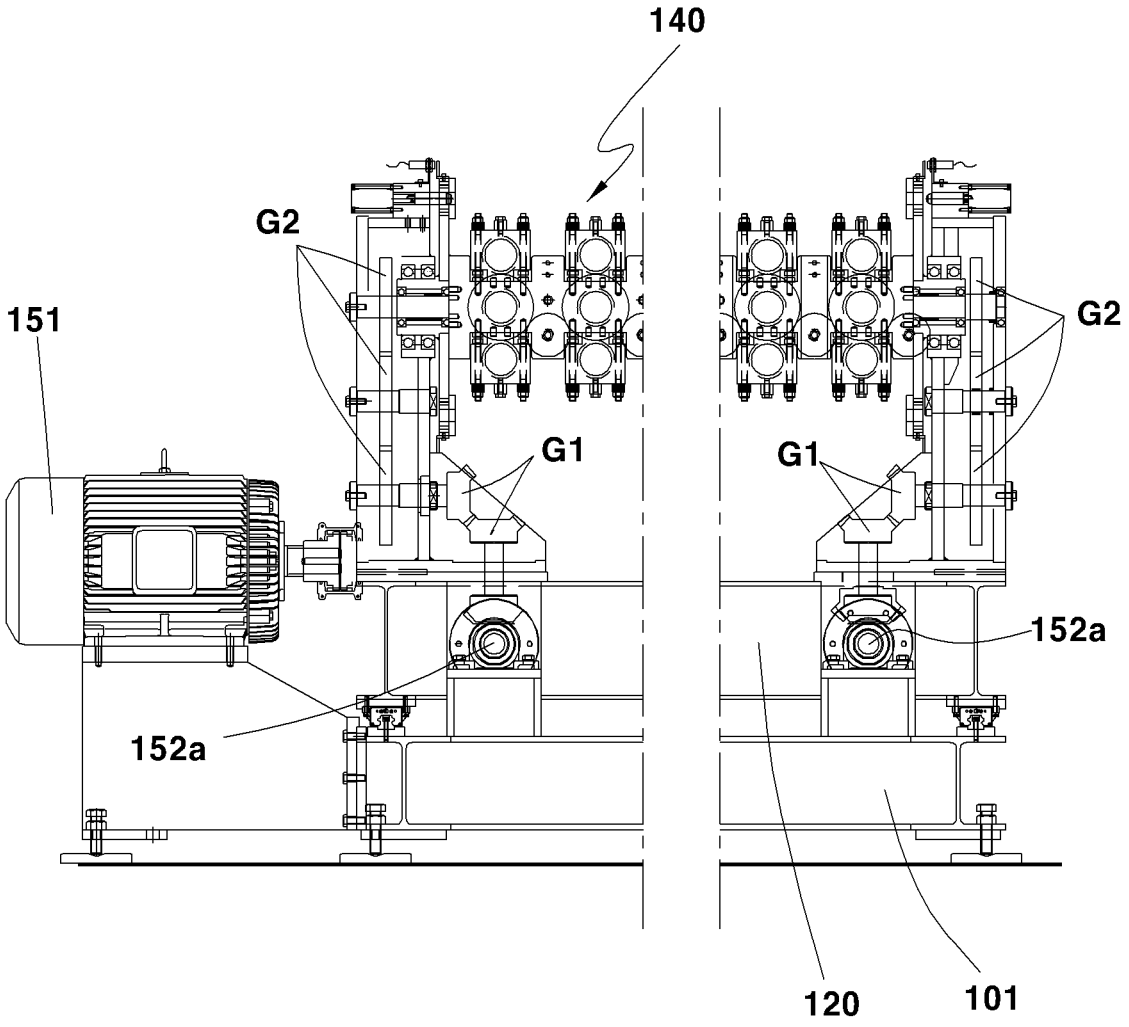
FIG. 5 is a front view showing the first rotary driving unit performing power transmission to the forming molding unit, shown in FIG. 4.

As shown in FIGS. 1 and 5, the first rotary driving unit 150 is installed on the stand 120 and is configured to transmit power to the forming rollers R of the forming molding unit 140. The first rotary driving unit 150 includes a main driving motor 151, first reducers 152 connected to the main driving motor 151 and installed at front and rear portions of the base 101 with output shafts 152*a* provided at opposite sides of each of the first reducers 152, and first gear driving parts 153 transmitting rotary power from the opposite output shafts 152*a* of the first reducers 152 to the forming rollers R of the forming molding unit 140.

The first gear driving parts 153 are configured to perform power transmission by engagement between bevel gears G1 and spur gears G2 engaged with the bevel gears G1, and the bevel gears G1 being installed on second roller shafts 144 at start and end positions of the supports 141 where the plate enters, is molded, and then is discharged, among the output shafts 152*a* and the second roller shafts 144 of the forming rollers R of the forming molding unit 140.

Figure 11:
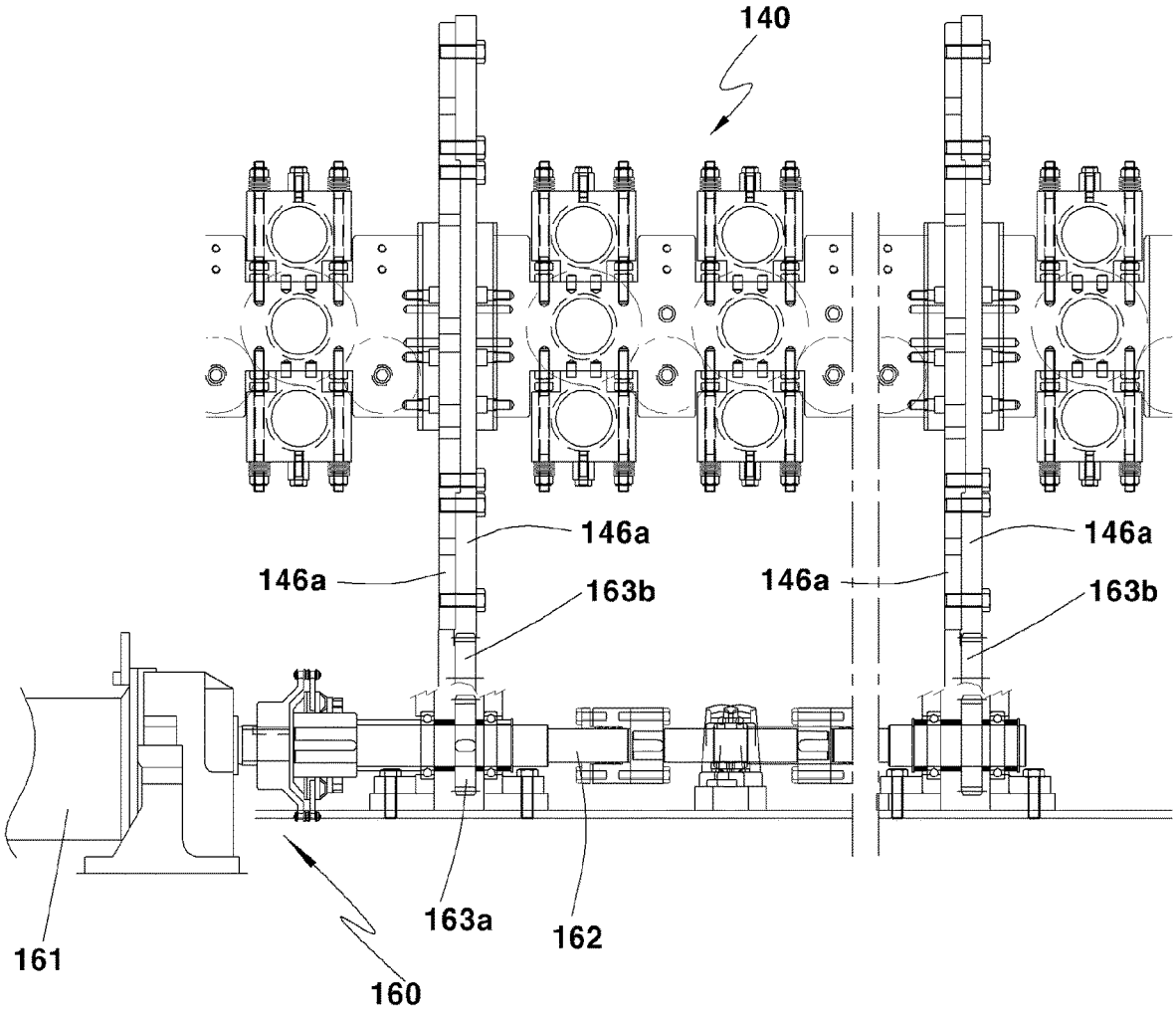
FIG. 11 is a front view showing a ring gear of the forming molding unit according to the present disclosure and a second rotary driving unit rotating the forming molding unit entirely by 180 degrees.
Figure 12:
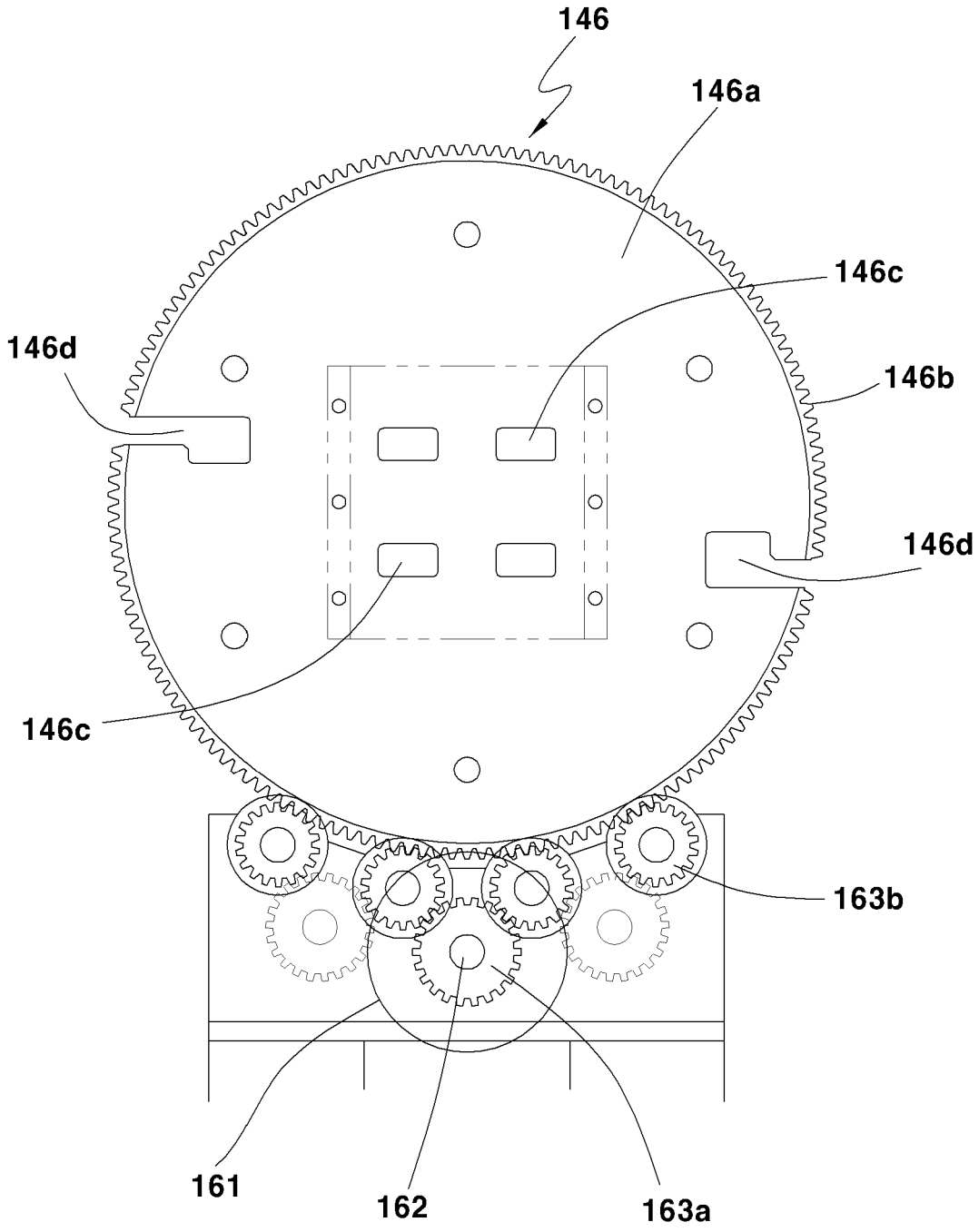
FIG. 12 is a side view showing a coupling state between a ring part and a gear part of the ring gear shown in FIG. 11.

As shown in FIGS. 2 and 11, the second rotary driving unit 160 is a part installed on the stand 120 and serves to rotate the entire forming molding unit 140 by 180 degrees against the fixing stands 130. The second rotary driving unit 160 includes a first driving motor 161 installed on the stand 120, a power transmission shaft 162 connected to a shaft of the first driving motor 161, a second gear driving part 163 provided on the stand 120, and including a driving gear 163*a* provided on the power transmission shaft 162 and a driven gear 163*b* disposed in an arc shape at one side of the driving gear to be engaged with the ring gear 146, the driving gear 163*a* and the driven gear 163*b* being rotatably provided.

The driving gear 163*a* and the driven gear 163*b* have diameter portions corresponding to the ring part of the ring gear to achieve supporting of rotation of the ring gear and engaged rotation with the ring gear at the same time so as to rotate the ring gear with engaged rotation with the driven gear.

Figure 10:
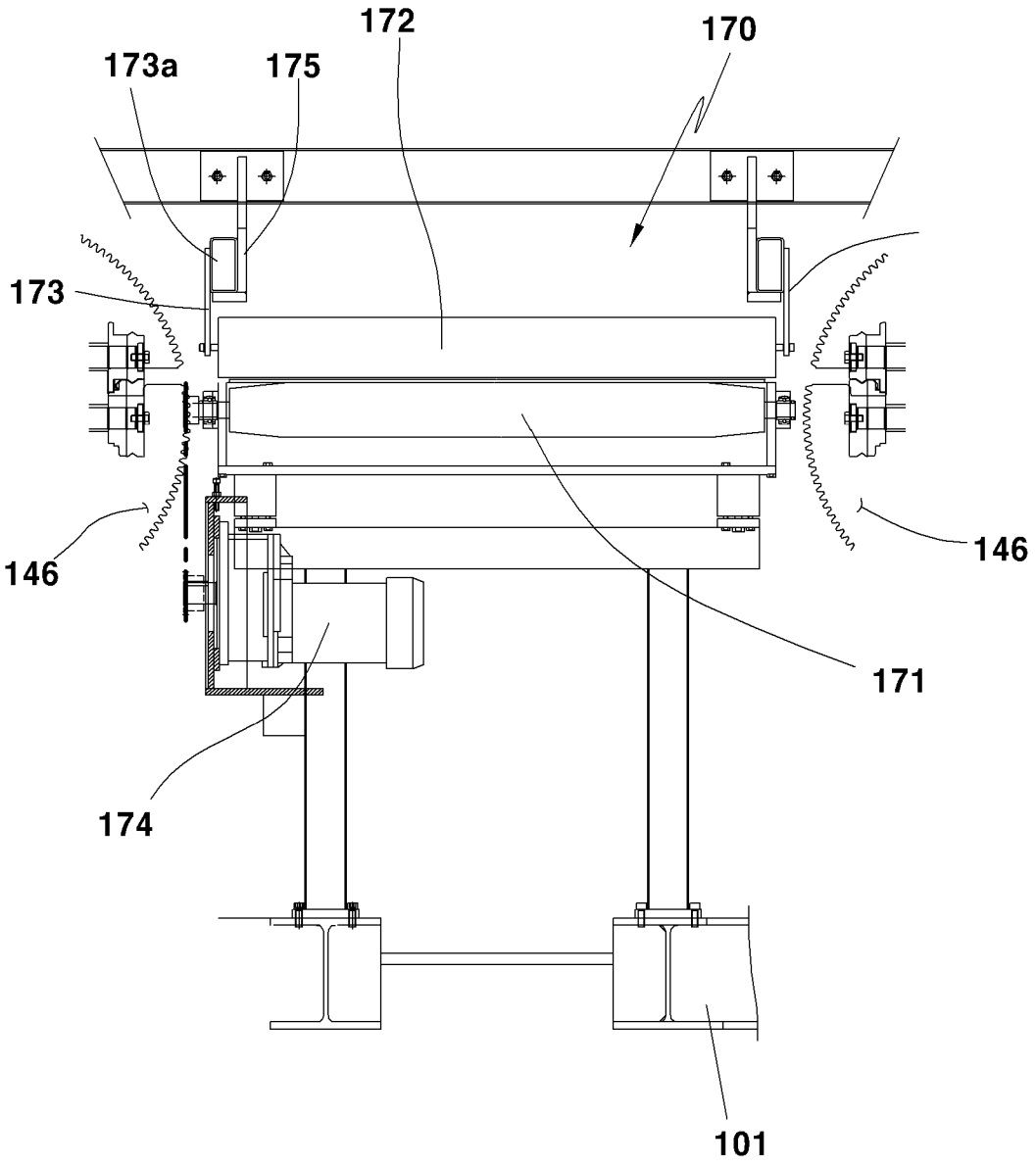
FIG. 10 is an abstracted-side view showing a transfer unit on a base according to the present disclosure.

As shown in FIGS. 3 and 10, the transfer unit 170 is provided to support the plate 1 having a plate shape and to enter and move the plate between the forming rollers of the opposite forming molding unit 140 in one direction, simultaneously.

The transfer unit 170 is provided to match a height level from the base 101 to the forming rollers R disposed in the forming molding unit 140, and includes a conveyor 171 transferring the plate 1, a pressure roller 172 provided to be spaced apart from an upper portion of the conveyor 171 to pressurize and guide an upper portion of the plate 1 seated and transferred on the conveyor and a pressure roller support 173, and a conveyor driving part 174 driving the conveyor 171 in one direction.

The pressure roller 172 is the weight and the pressure roller support 173 is connected to each of opposite shaft ends of the pressure roller, and a roller 173*a* is provided on one end of the pressure roller support 173 so that the roller 173*a* is seated and rollable on a rail 175 provided at an upper portion of the transfer unit 170.

In other words, the pressure roller 172 presses an upper surface of the plate 1 entering an upper surface of the conveyor 171 and is moved together with the plate while pressing the plate to a position where the plate finally passes the forming device, and is configured to be returned to an initial state thereof along the rail when the plate that has completed in pocket flange molding is finally discharged.

The rail 175 is installed in an attached manner at a structure installed in an arc shape from the base 101.

Figure 16A:
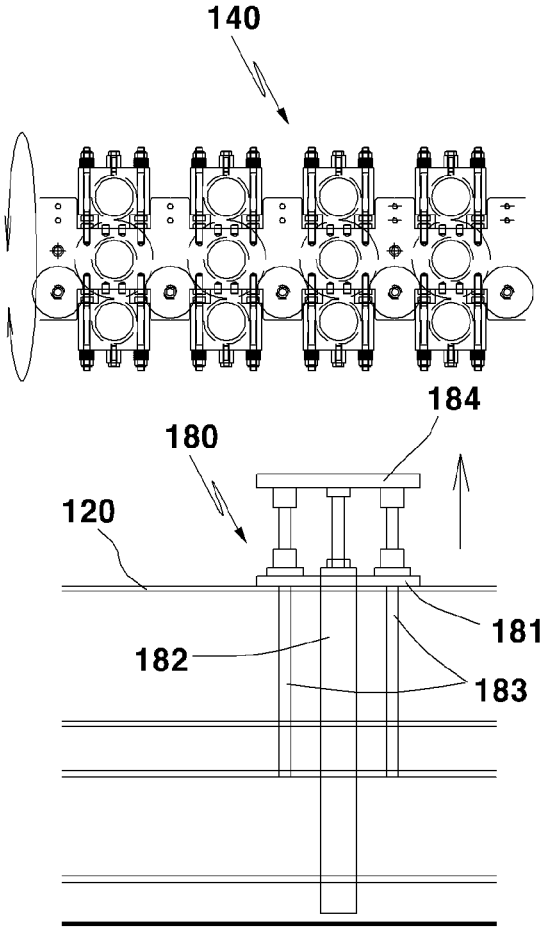
Figure 16B:
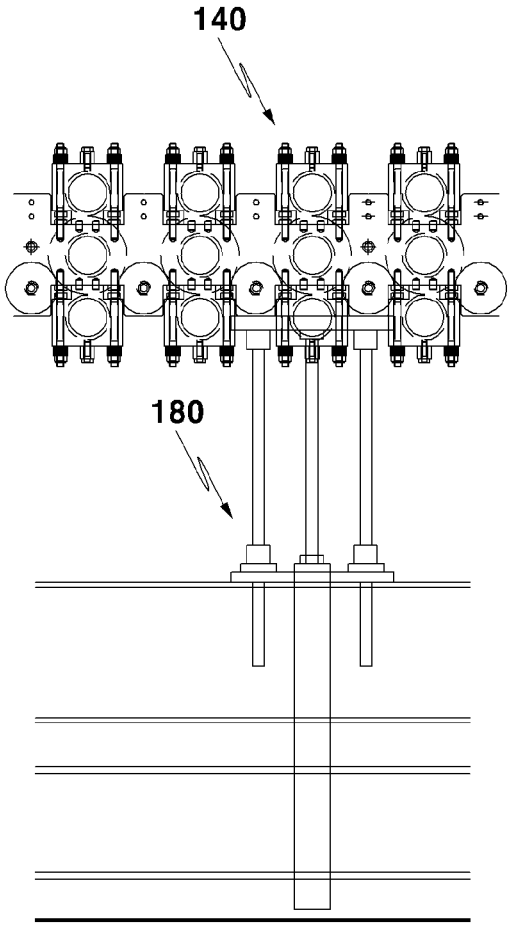

As shown in FIGS. 2 and 16, each of the elevation stand unit 180 is installed on the stand 120 to be raisable and lowerable and to support a lower portion of the rotated forming molding unit 140. The elevation stand unit 180 includes a support plate 181 securely installed on the stand 120, a hydraulic cylinder 182 securely installed vertically from the support plate 181, and guide rods 183 formed by penetrating a plurality of positions on the support plate 181, connected with the hydraulic cylinder 182 and an elevation support block 184 connected to ends of the guide rods 183 to support the lower portion of each of the supports 141 of the forming molding unit 140.

The guide rods 183 are configured to be raisable and lowerable in response to raising and lowering of an operation rod of the hydraulic cylinder 182 while supporting the elevation support block 184 from the support plate 181 at the same time.

Figure 14:
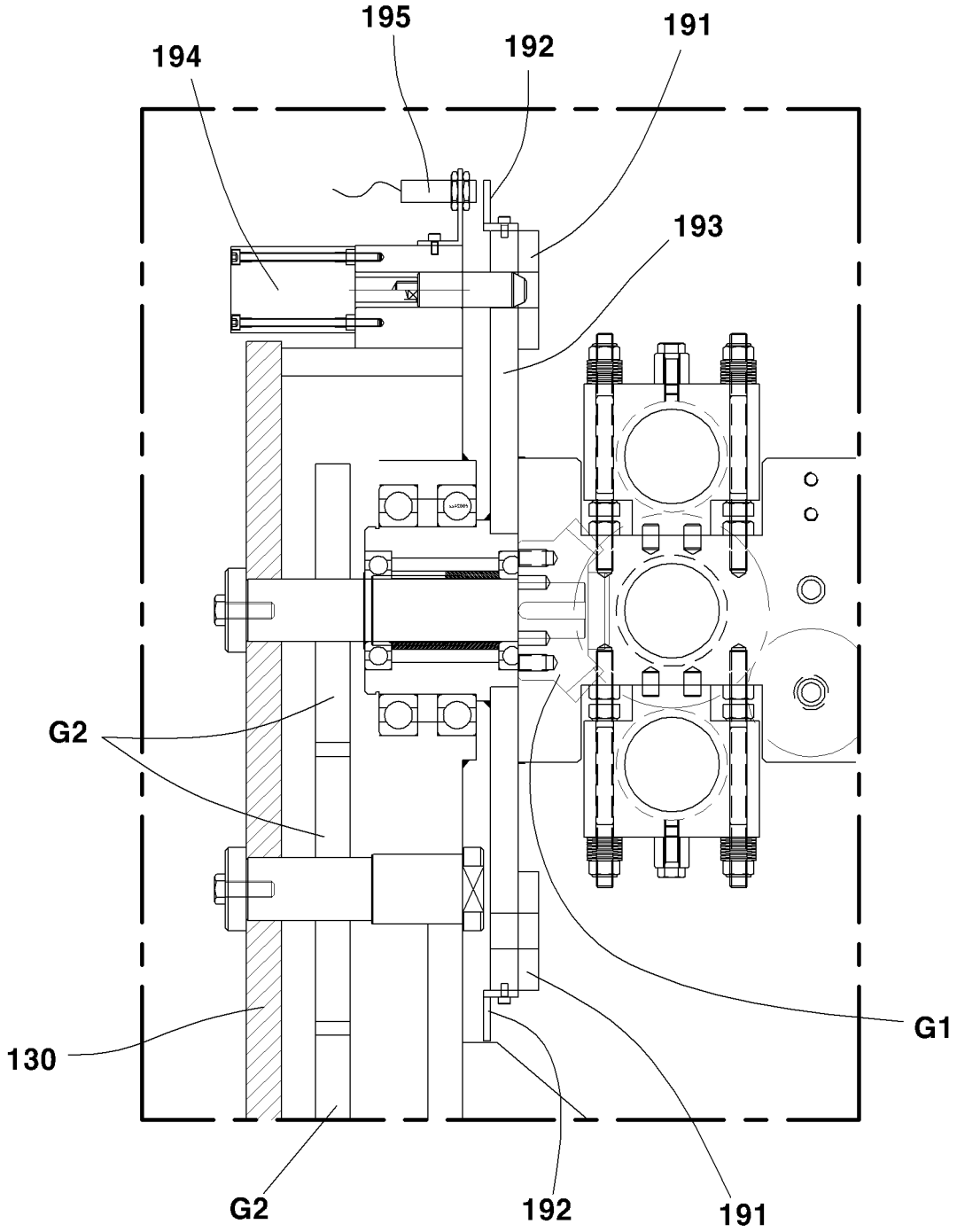
FIG. 14 is an abstracted-front view showing a fixation unit fixing the forming molding unit while the forming molding unit according to the present disclosure is rotated by 180 degrees.
Figure 15:
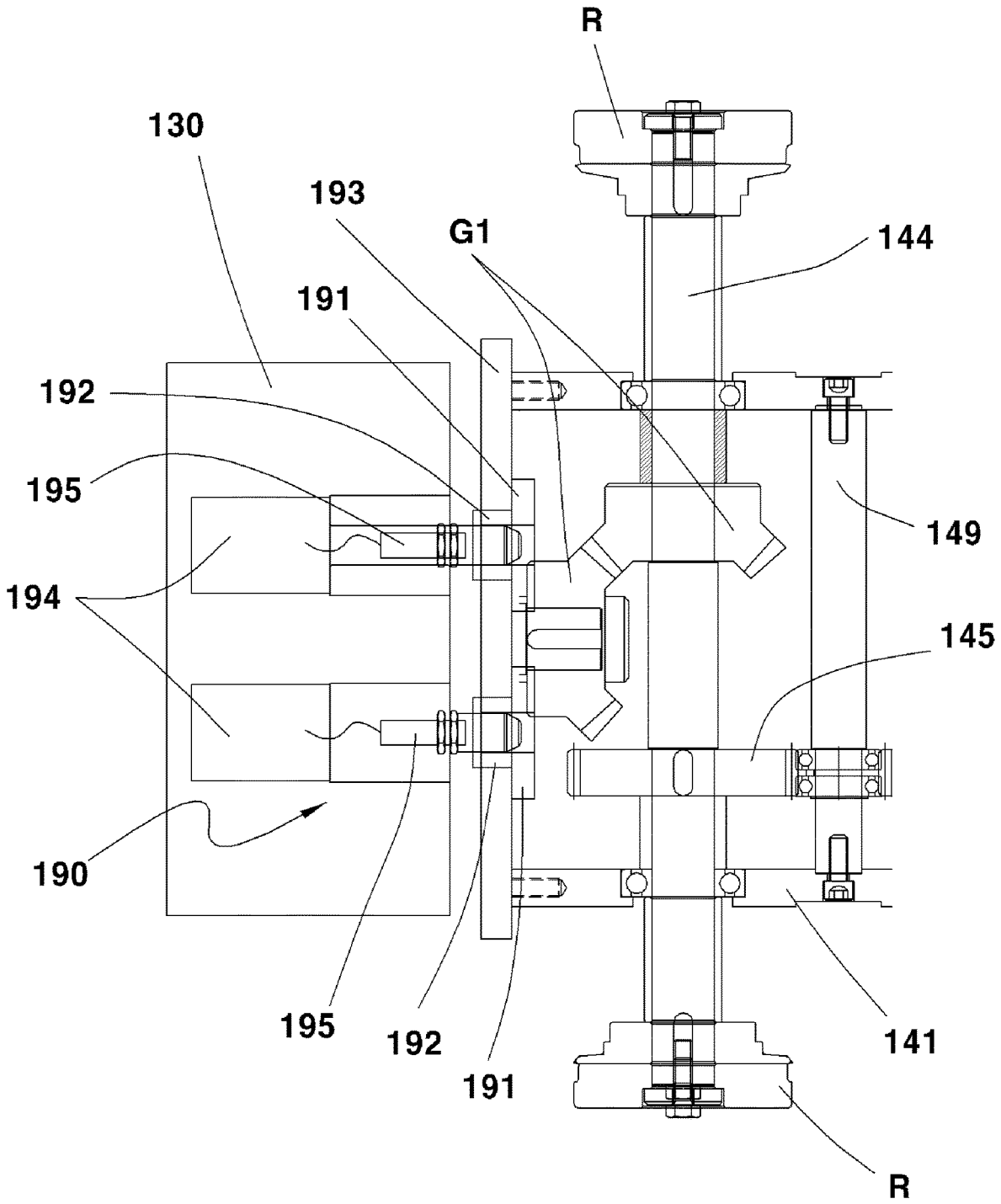
FIG. 15 is an enlarged-plan view showing the fixation unit shown in FIG. 14, FIGS. 16A and 16B are front views showing an elevation stand unit support a lower surface of the forming molding unit according to the present disclosure.

As shown in FIGS. 14 and 15, the fixation unit 190 is installed on each of the upper portion of the fixing stand 130 to fix the forming molding unit 140 that are rotated by 180 degrees. The fixation unit 190 is securely installed at each of one support 141 at the front end side where the plate enters and one support 141 at the rear end side through which the plate is discharged, among the supports 141 of the forming molding unit 140. The fixation unit 190 has a plurality of fixing blocks 191 on upper and lower portions, a rotation plate 193 including sensor detection stands 192, a pair of fixing cylinders 194 installed at an upper portion of the fixing stand 130 on the stand 120 to hold the fixing blocks 191, and detection sensors 195 securely installed at upper portions of the fixing cylinders 194 detecting the sensor detection stands 192.

An operation according to manufacture of a pocket flange for a duct using the forming device according to the present disclosure configured as described above will be described as follows.

First, according to the present disclosure, the forming device 100 is set at the forming molding unit 140 installed at the opposite ends of the forming device 100 to match with a size of a pocket flange 1*a* to be processed on the opposite ends of the plate 1 in a molding method.

The setting of the forming molding unit 140 is configured to use the gap adjusting part 110 to set forming rollers to form the pocket flanges 1*a* having correspond sizes, among the forming rollers R of the opposite forming molding unit.

In other words, after setting is configured whether the pocket flanges 1*a* formed on the opposite side portions of the plate 1 will be molded into the same standard or the pocket flanges 1*a* on either side will be molded into different sizes, the pocket flanges 1*a* are molded.

In addition to the setting of the forming molding unit 140, the gap adjusting part 110 selects the forming rollers R disposed in a row on the opposite sides of the forming molding unit on the basis of the molding size.

The gap adjusting part 110 adjusts a gap between the support with the forming molding unit 140 to match with a width of the plate 1, and adjustment is performed by operating the second driving motor 111 installed on the base 101.

A first end of the gap adjusting part 110 is connected to an output shaft end of the second reducer 112 to which power transmission is performed through the second reducer 112 connected to the second driving motor 111, and a second end thereof passes through a side surface of the stand 120 to rotate the transfer screw shaft 113 rotatably supported on the base 101.

As the transfer screw shaft 113 is rotated, the guide 115 coupled to the guide rail 114 may be moved leftward or rightward.

Accordingly, a gap between the forming molding unit 140 and another forming molding unit 140 that are rotatably installed on the fixing stands 130 at the stands 120 disposed on the upper left and right portions of the base 101 can be adjusted to match with the width of the plate 1 for molding a duct flange part.

As described above, in the state when gap adjustment of the forming molding units 140 is completed through the gap adjusting part 110, positions of the forming rollers R at the forming molding units 140 are set.

At this point, position setting of the forming rollers R means that forming rollers R matching to mold the pocket flanges 1*a* having the corresponding sizes, among forming rollers R respectively coupled to one end of each of the first roller shafts 143 disposed and installed at the supports 141 of the forming molding unit 140 and one end of each of the second roller shafts 144, are adjusted to be disposed on positions continuously arranged in a longitudinal direction of the support 141.

In other words, in the supports 141 of the forming molding unit 140, which correspond to each other, each of the forming rollers R of the first roller shafts 143 at the shaft fixing stands 142 provided to be vertically adjusted on the upper and lower side portions at the opposite sides of the supports 141 and each of the forming rollers R of the second roller shafts 144 rotatably installed on the support 141 are disposed in pair in one direction.

This setting allows the opposite longitudinal edges of the plate 1 to enter the forming molding units 140 facing each other in one direction and the pocket flanges 1*a* having the corresponding sizes to be molded through the plurality of upper and lower forming rollers R facing each other.

With respect to the forming rollers R disposed into pair, the shaft fixing stands 142 are guided to depressed portions provided on longitudinal edges of the support 141, and a gap thereof is adjusted at the upper and lower portion of the support 141 by a degree of fastening between a fastening bolt, nut, and compression spring, so that a gap between the forming rollers R on the first roller shafts 143 and the forming rollers R of the second roller shafts 144 penetrating through and supported on the support 141 to be directly rotatable can be adjusted.

Each of the forming rollers R of the forming molding unit 140 has a structure in which rotary driving is implemented as the driving gears 145 coupled to the first roller shafts 143 and the second roller shafts 144 are engaged with each other, in order to located the forming rollers R matching with the corresponding sizes, the forming molding unit 140 is entirely rotated by 180 degrees.

Rotation change of 180 degrees of the forming molding unit 140 is changed in position by the second rotary driving unit 160 installed on the stand 120.

Rotation of 180 degrees of the forming molding unit 140 is performed by the second rotary driving unit 160 installed on the stand 120.

The second rotary driving unit 160 is configured such that, when the first driving motor 161 installed on the stand 120 is driven, the power transmission shaft 162 connected to the shaft of the first driving motor 161 rotates the driving gear 163*a* of the second gear driving part 163, and the ring gear 146 at the forming molding unit 140 engaged with the driving gear 163*a* is rotated while driven gears 163*b* disposed at one side of the driving gear 163*a* into an arc shape are engaged with the gear part 146*b* of the ring gear 146.

Each of the driven gears 163*b* engaged with the driving gear 163*a* has a diameter portion 163*b*-1 that is in close contact with an outer circumferential portion of the ring part 146*a* of the ring gear 146. The diameter portion 163*b*-1 is provided to allow the engaged rotation between the gear part, the driving gear, and the driven gear in addition to support of rotation of the ring gear 146, at the same time, and to allow the ring gear 146 to be smoothly rotated.

In other words, rotation of the ring gear 146 through the second rotary driving unit 160 as described above is changed at a position of 180 degrees so that a forming roller R can be located to a corresponding position.

In the state in which a molding position for the corresponding size is changed as the forming molding unit is rotated by 180 degrees, as the forming molding unit is fixed by the fixation unit 190 installed on the fixing stand 130 rotatably supporting the forming molding unit 140, and the lower portion of the forming molding unit 140 is supported by the elevation stand unit 180 installed on the stand 120 installed at a position spaced apart from the lower portion of the support 141 of the forming molding unit 140, 180 degrees rotation setting of the forming molding unit is completed.

The elevation stand unit 180 is configured such that, the elevation support block 184, to which the operation rod of the hydraulic cylinder 182 on the support plate 181 securely installed on the stand 120 and the guide rods 183 penetrating and supported on the support plate at the plurality of points are connected, is lowered in the rotated stated of the forming molding unit 140 and the elevation support block 184 is raised to support the lower portion of the support 141 in the rotation completion state of the forming molding unit 140 as described above, so that sagging of the support relatively long is prevented.

The fixation unit 190 installed on the fixing stand 130 is securely installed at the supports 141 at the front end side and the rear end side where the plate 1 enters and is discharged, among the supports 141 of the forming molding unit 140 rotated by 180 degrees, and the plurality of fixing blocks 191 are provided at the upper and lower portions of each of the fixation units, and in the state in which the rotation plate 193 having the sensor detection stands 192 is rotated by 180 degrees together with the forming molding unit, the fixing cylinders 194 installed on the upper portion of the fixing stand 130 on the stand 120 are operated a signal of the detection sensor 195 that detects the sensor detection stands 192.

The fixing cylinders 194 include the pair of fixing cylinders and operation rods of the fixing cylinders are moved forward at the same time, and rotation of the forming molding unit 140 is prevented as the operation rods are operated to be inserted into the fixing blocks 191.

As described above, when all settings for forming molding are completed, for molding of the pocket flanges 1*a* of a duct, the plate 1 enters the forming device 100 through the transfer unit 170 disposed between the forming molding units 140 of the forming device 100.

The plate 1 enters the forming device by being seated on the upper surface of the conveyor 171 with operation of the conveyor driving part 174 of the transfer unit 170 and simultaneously passes through the forming rollers of the forming molding units disposed at the opposite sides and a multistage work such as bending, folding, compressing, etc. can be sequentially performed.

At this point, the upper surface of the plate 1 is pressurized by the pressure roller 172, which is installed to be spaced apart from the upper portion of the conveyor 171 and pressurizes and guides the upper portion of the plate 1 transferred in a seated state on the conveyor 171, while the roller at the pressure roller support 173 is moved along the rail.

As the plate passing between the forming rollers disposed at the opposite sides passes through the cut groove parts 146*d* of the ring gear, molding continues.

The forming rollers R installed at each of the forming molding units are rotated by driving the main driving motor 151 constituting the first rotary driving unit 150 of the forming device of the present disclosure with power transmission through the first gear driving parts 153 connected to the output shafts 152*a* at the opposite sides of the first reducers 152 connected to the main driving motor 151.

The first gear driving parts 153 is configured to perform power transmission by mutual engagement between the bevel gears G1 and the spur gears G2 engaged with the bevel gears G1, and the bevel gears G1 being installed on second roller shafts 144 at start and end positions of the supports 141 where the plate enters, is molded, and then is discharged, among the output shafts 152*a* and the second roller shafts 144 of the forming rollers R of the forming molding units 140.

The driving gears 145 are coupled to the first roller shafts 143 and the second roller shafts 144 to which the forming rollers R are coupled. As the driving gears 145 are engaged with each other and are rotated together, the forming rollers installed one support 141 are rotated.

The driving gears 145 are engaged with the idle gear 148 installed on the shaft of which opposite ends are shaft-installed at the support 141 to transmit rotary power.

In addition, power transmission between one support and another support is performed through the roller power transmission part 147, and power is transmitted through connection between the sprocket wheels W coupled to the second roller shafts 144 of the supports 141 at the opposite sides based on the ring gear 146 and the chain C connecting the sprocket wheels to each other. Accordingly, in addition to rotation driving of all the forming rollers, molding of the plate passing through the forming rollers is performed.

In addition to the forming molding, when molding of the plate 1 moved by the transfer unit 170 is completed and is separated from the transfer unit, the pocket flange molding is completed on the longitudinal edges at the opposite sides of the final plate, and the plate is cut to match with a size of a duct made into a square shape to form the duct having the pocket flanges as connecting portions at the opposite ends of the duct.

Figure 18A:
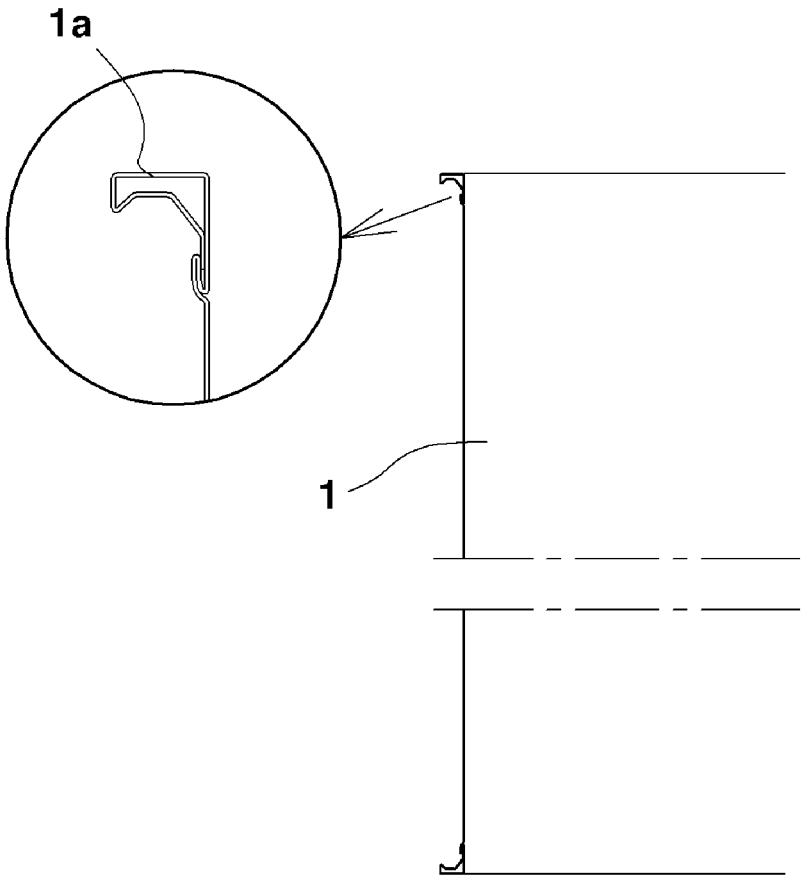
FIGS. 18A and 18B are side sectional views showing molded states of pocket flanges with different standards through the forming device according to the present disclosure.
Figure 18B:
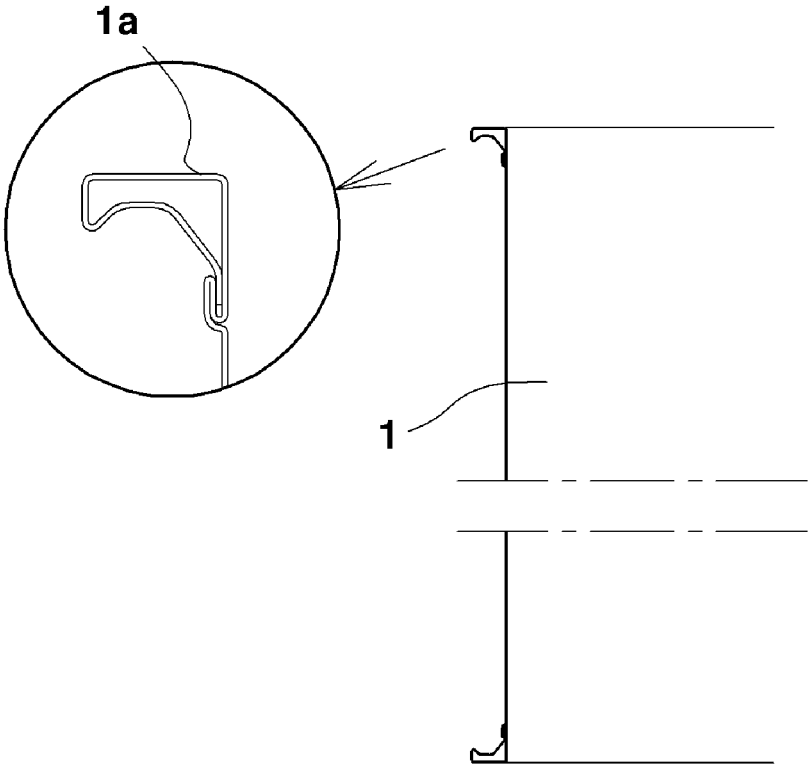

Referring to FIGS. 18A and 18B, the views show states where molding of the pocket flanges 1*a* is completed on the opposite ends of the plate 1. The pocket flange can be molded with different sizes according to the sizes of the first forming rollers and the second forming rollers. When molding is performed with any one of the forming molding units 140 rotated by 180 degrees, pocket flanges having different sizes at left and right portions can be molded.

FIG. 18A is a view showing small pocket flanges molded through the forming device as described above. FIG. 18B is a view showing pocket flanges larger than the pocket flanges shown in FIG. 18A.

Figure 19:
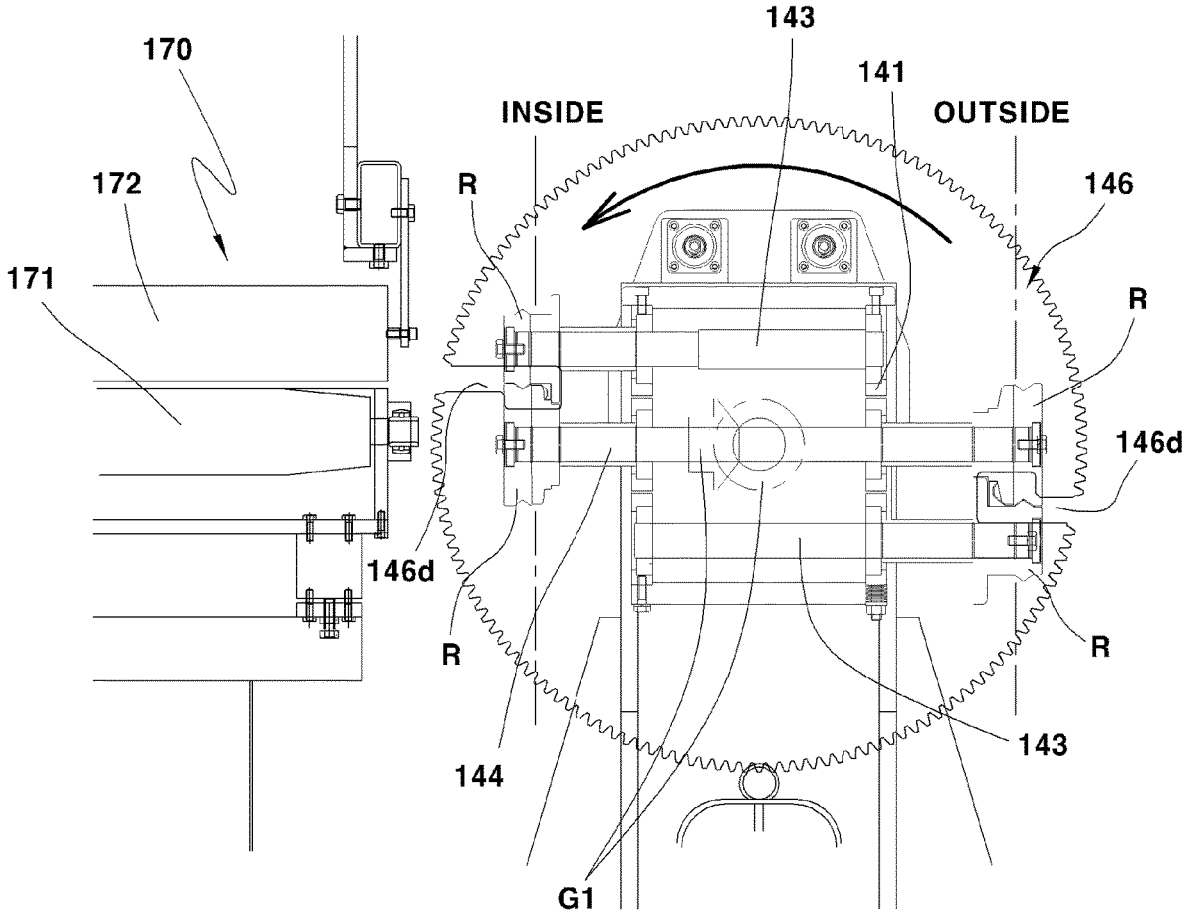
FIG. 19 is a side view showing a change in location of the forming rollers in response to rotation of the forming molding unit according to the present disclosure.

In order to mold the large pocket flanges, as shown in FIG. 19, the ring gear 146 of the forming molding unit 140 is rotated by 180 degrees by operation of the second rotary driving unit 160 and, as described above, when the drawing is defined based on the elevation stand unit 180 and the fixation unit 190, the inside forming rollers and the outside forming rollers are changed in positions thereof, so that the plate 1 inserted with the transfer unit 170 can be molded with a corresponding size.

As the ring gear 146 is rotated by 180 degrees, the forming molding unit may change the positions of the upper and lower first roller shafts 143 from each other on the basis of a center shaft of the rotation plate 193 interconnected to the fixing stand 130, i.e., the second roller shaft 144 of the forming molding unit.

In other words, when the position setting of the forming rollers at the opposite sides is changed from the outside forming rollers to the inside forming rollers based on the drawings, the forming device is switched into large pocket flange molding manufacture as described above to produce products.

Although the present disclosure is described with reference to specific items such as specific structural elements, to merely some embodiments, and to drawings, such specific details disclosed herein are merely representative for purposes of helping more comprehensive understanding of the present disclosure. The present disclosure, however, is not limited to only the example embodiments set forth herein, and those skilled in the art will appreciate that the present disclosure can be embodied in many alternate forms.

Accordingly, the present disclosure is intended to cover not only the exemplary embodiments, but also various alternatives, modifications, equivalents and other embodiments that may be included within the spirit and scope of the present disclosure as defined by the appended claims.

What is claimed is:

1. A pocket flange forming device for a duct, the pocket flange forming device being configured to mold pocket flanges (1*a*), which are connecting portions of a duct, on longitudinal edge portions at opposite ends of a plate (1) made of a rectangular metal plate, through a sequential forming process, the forming device (100) comprising:

a base (101) combined with a beam and constructed from a bottom surface;

a stand (120) disposed at each of left and right portions of an upper portion of the base (101) to be in parallel to each other and provided to be movable by a gap adjusting part (110) provided at the upper portion of the base (101);

a fixing stand (130) disposed at each of front and rear sides of upper left and right portions of the stand (120) to correspond to each other;

a forming molding unit (140) rotatably provided between the fixing stand (130) and another fixing stand (130) at the front and rear sides, and comprising a plurality of forming rollers (R) continuously provided at opposite sides of supports (141) corresponding to each other to form pocket flanges on longitudinal edges at opposite sides of the plate (1) inserted between the forming rollers, by sequentially performing molding process of bending, folding, and compressing;

a first rotary driving unit (150) provided at the stand (120) and configured to transmit power to the forming rollers (R) of the forming molding unit (140);

a second rotary driving unit (160) provided at the stand (120) and configured to rotate the entire forming molding unit (140) by 180 degrees against the fixing stand (130);

a transfer unit (170) provided at the upper portion of the base (101) and configured to support the plate (1) to transfer the plate (1) to the forming molding unit (140) provided at the opposite sides, in one direction;

an elevation stand unit (180) provided at an upper portion of the stand (120) to be raisable and lowerable and configured to support a lower portion of the rotated forming molding unit (140); and a fixation unit (190) provided on an upper portion of the fixing stand (130) and configured to fix the forming molding unit (140) rotated by 180 degrees, wherein the fixation unit (190) is securely provided at each of supports (141) located at a front side and a rear side where the plate enters and is discharged, among the supports (141) of each of the forming molding unit (140), and wherein the fixation unit (190) comprises:

a rotation plate (193) comprising a plurality of fixing blocks (191) provided at upper and lower portions thereof, and sensor detection stands (192);

a pair of fixing cylinders (194) provided on an upper portion of the fixing stand (130) on the stand (120) and holding the fixing blocks (191); and detection sensors (195) securely provided on upper portions of the fixing cylinders (194) to detect the sensor detection stands (192).

2. The pocket flange forming device of claim 1, wherein the gap adjusting part (110) comprises:

a second driving motor (111) provided on the base (101), a second reducer (112) connected to the second driving motor (111) to transmit power, a transfer screw shaft (113) of which a first end is connected to an output shaft end of the second reducer (112) and a second end is rotatably supported on the base (101) while passing through a lateral surface of the stand (120), and a guide rail (114) and a guide (115), the guide rail (114) being configured to guide each of the stand (120) and another stand (120) at left and right sides on the base (101) with the transfer screw shaft (113) and the guide (115) being provided at a lower portion of the stand (120) to be guided along the guide rail (114).

3. The pocket flange forming device of claim 1, wherein the first rotary driving unit (150) comprises:

a main driving motor (151), a first reducer (152) connected to the main driving motor (151), comprising output shafts (152*a*) at opposite sides thereof, and respectively provided at each of front and rear portions of the base (101), and a first gear driving part (153) configured to transmit power from each of the opposite output shafts (152*a*) of the first reducer (152) to the forming rollers (R) of the forming molding unit (140).

4. The pocket flange forming device of claim 1, wherein the transfer unit (170) comprises:

a conveyor (171) provided to match with a height level of the forming rollers (R) disposed in the forming molding unit (140) from the base (101) and configured to transfer the plate (1), a pressure roller (172) and a pressure roller support (173), the pressure roller (172) being provided to be spaced apart from an upper portion of the conveyor (171) and configured to pressurize and guide an upper portion of the plate (1) that is seated and transferred on the conveyor (171), and a conveyor driving part (174) configured to drive the conveyor (171) in one direction.

5. The pocket flange forming device of claim 1, wherein the elevation stand unit (180) comprises:

a support plate (181) securely provided on the stand (120), a hydraulic cylinder (182) securely provided to be vertical from the support plate (181) and guide rods (183) passing through a plurality of points on the support plate (181), and an elevation support block (184) connected to an end of an operation rod of the hydraulic cylinder (182) and ends of the guide rods (183) to support a lower portion of each of the supports (141) of the forming molding unit (140).

6. A pocket flange forming device for a duct, the pocket flange forming device being configured to mold pocket flanges (1*a*), which are connecting portions of a duct, on longitudinal edge portions at opposite ends of a plate (1) made of a rectangular metal plate, through a sequential forming process, the forming device (100) comprising:

a base (101) combined with a beam and constructed from a bottom surface;

a stand (120) disposed at each of left and right portions of an upper portion of the base (101) to be in parallel to each other and provided to be movable by a gap adjusting part (110) provided at the upper portion of the base (101);

a fixing stand (130) disposed at each of front and rear sides of upper left and right portions of the stand (120) to correspond to each other;

a forming molding unit (140) rotatably provided between the fixing stand (130) and another fixing stand (130) at the front and rear sides, and comprising a plurality of forming rollers (R) continuously provided at opposite sides of supports (141) corresponding to each other to form pocket flanges on longitudinal edges at opposite sides of the plate (1) inserted between the forming rollers, by sequentially performing molding process of bending, folding, and compressing;

a first rotary driving unit (150) provided at the stand (120) and configured to transmit power to the forming rollers (R) of the forming molding unit (140);

a second rotary driving unit (160) provided at the stand (120) and configured to rotate the entire forming molding unit (140) by 180 degrees against the fixing stand (130);

a transfer unit (170) provided at the upper portion of the base (101) and configured to support the plate (1) to transfer the plate (1) to the forming molding unit (140) provided at the opposite sides, in one direction;

an elevation stand unit (180) provided at an upper portion of the stand (120) to be raisable and lowerable and configured to support a lower portion of the rotated forming molding unit (140); and a fixation unit (190) provided on an upper portion of the fixing stand (130) and configured to fix the forming molding unit (140) rotated by 180 degrees, wherein each of the supports (141) corresponding to each other of the forming molding unit (140) comprises:

one or more shaft fixing stands (142) continued in a longitudinal direction, and provided to be vertically adjustable at upper and lower portions at opposite sides of the supports (141), and a first roller shaft (143) rotatably provided to each of the shaft fixing stands (142) and coupled to, at opposite ends thereof, the forming rollers (R), a second roller shaft (144) rotatably provided on the supports (141), and coupled to, at opposite ends thereof, forming rollers (R) to match with the forming rollers (R) on the first roller shaft (143) for forming molding, a driving gear (145) coupled to each of the first roller shaft (143) and the second roller shaft (144) and configured to allow engagement rotation driving, a ring gear (146) connected to one of the supports (141) and another support (141) while being located therebetween, and configured to be transmitted with power from the second rotary driving unit (160) to rotate the forming molding unit (140) entirely, and a roller power transmission part (147) provided at second roller shafts (144) at the supports (141) at the opposite sides based on the ring gear (146) and configured to rotate the second roller shafts (144) at the supports (141) in the same rotating direction.

7. The pocket flange forming device of claim 6, wherein the roller power transmission part (147) comprises a sprocket wheel (W) coupled to the second roller shaft (144) at the supports (141) at opposite sides based on the ring gear (146) and a chain (C) connecting the sprocket wheel (W) to another sprocket wheel (W).

8. The pocket flange forming device of claim 7, wherein the ring gear (146) comprise:

a ring part (146*a*), a gear part (146*b*), the gear part (146*b*) engaged with the roller power transmission part (147), the gear part (146*b*) being combined with one side of the ring part (146*a*), a through hole (146*c*) formed in each of upper and lower positions for penetration of the chain (C), and a cut groove part (146*d*) formed in each of opposite portions of the ring gear (146) for passing the plate (1) to be formed.

9. The pocket flange forming device of claim 6, wherein the forming rollers comprise:

an upper forming roller coupled to a first portion of a first roller shaft of an upper shaft fixing stand, and a lower forming roller coupled to a second portion of a first roller shaft of a lower shaft fixing stand, wherein the upper forming roller and the lower forming roller have different sizes.

10. The pocket flange forming device of claim 7, wherein the first gear driving part (153) is configured to achieve power transmission by engagement between bevel gears (G1) and spur gears (G2) engaged with the bevel gears (G1) that are provided at the output shafts (152*a*) of the first reducer (152) and at second roller shaft (144) of supports (141) located at a start position and an end position where the plate enters, is molded, and then is discharged, among second roller shafts (144) of the forming rollers (R) of each of the forming molding unit (140).

11. The pocket flange forming device of claim 6, wherein the second rotary driving unit (160) comprises:

a first driving motor (161) provided on the stand (120), a power transmission shaft (162) connected to a shaft of the first driving motor (161), and a second gear driving part (163) provided on the stand (120), and comprising a driving gear (163*a*) and a driven gear (163*b*) that are rotatably provided, the driving gear (163*a*) being provided on the power transmission shaft (162) and the driven gear (163*b*) being disposed in an arc shape at one side of the driving gear (163*a*) to be engaged with the ring gear (146).

12. The pocket flange forming device of claim 6, wherein the second rotary driving unit (160) comprises:

a first driving motor (161) provided on the stand (120), a power transmission shaft (162) connected to a shaft of the first driving motor (161), and a second gear driving part (163) provided on the stand (120), and comprising a driving gear (163*a*) and a driven gear (163*b*) that are rotatably provided, the driving gear (163*a*) being provided on the power transmission shaft (162) and the driven gear (163*b*) being disposed in an arc shape at one side of the driving gear (163*a*) to be engaged with the ring gear (146).

* * * * *